US010894413B2

(12) United States Patent
Kanazawa et al.

(10) Patent No.: US 10,894,413 B2
(45) Date of Patent: Jan. 19, 2021

(54) LIQUID EJECTING APPARATUS AND METHOD OF MAINTAINING LIQUID EJECTING APPARATUS

(71) Applicant: SEIKO EPSON CORPORATION, Tokyo (JP)

(72) Inventors: Yuji Kanazawa, Shiojiri (JP); Masaaki Ando, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/669,023

(22) Filed: Oct. 30, 2019

(65) Prior Publication Data

US 2020/0130355 A1 Apr. 30, 2020

(30) Foreign Application Priority Data

Oct. 30, 2018 (JP) ..... 2018-203699

(51) Int. Cl.
*B41J 2/165* (2006.01)

(52) U.S. Cl.
CPC ..... *B41J 2/16505* (2013.01); *B41J 2/16511* (2013.01); *B41J 2/16523* (2013.01); *B41J 2/16532* (2013.01); *B41J 2/16535* (2013.01); *B41J 2/16538* (2013.01); *B41J 2/16544* (2013.01)

(58) Field of Classification Search
CPC ..... B41J 2/16505; B41J 2/16511; B41J 2/16514; B41J 2/16517; B41J 2/16521; B41J 2/16523; B41J 2/16532; B41J 2/16535; B41J 2/16544; B41J 2/16547; B41J 2/16552; B41J 2/16558; B41J 29/17
See application file for complete search history.

(56) References Cited

U.S. PATENT DOCUMENTS 5,670,997 A * 9/1997 Sugimoto ..... B41J 2/16508 347/30
6,350,007 B1 * 2/2002 Meichle ..... B41J 2/16552 347/27
8,820,887 B2 * 9/2014 Kamiyama ..... B41J 2/16552 347/29

(Continued)

FOREIGN PATENT DOCUMENTS

JP H11263022 9/1999
JP 2004195932 7/2004

(Continued)

*Primary Examiner* — Anh T Vo
(74) *Attorney, Agent, or Firm* — Workman Nydegger

(57) ABSTRACT

A liquid ejecting apparatus includes a liquid ejector having a nozzle surface having nozzles, a cap configured to perform capping when coming into contact with the nozzle surface, a capping mechanism configured to move the cap between a capping position for the capping and a separated position separated from the nozzle surface, a cleaning-liquid supply mechanism configured to supply a cleaning liquid into the cap, and a facing portion configured to face a lip portion of the cap coming into contact with the nozzle surface in the capping, in which the lip portion and the facing portion are made to face each other and a predetermined space is provided between the lip portion and the facing portion for the cleaning liquid supplied in the cap to come into contact with the facing portion.

12 Claims, 12 Drawing Sheets

(56) References Cited

U.S. PATENT DOCUMENTS

| | | | | |
|---|---|---|---|---|
| 2011/0227998 | A1* | 9/2011 | Kamiyama | B41J 2/16505 347/29 |
| 2013/0127940 | A1* | 5/2013 | Fujikawa | B41J 2/16517 347/14 |
| 2013/0265364 | A1 | 10/2013 | Kawakami et al. | |
| 2018/0079217 | A1* | 3/2018 | Hiratsuka | B41J 2/16585 |

FOREIGN PATENT DOCUMENTS

| | | |
|---|---|---|
| JP | 2007185795 | 7/2007 |
| JP | 2008080209 | 4/2008 |
| JP | 2010201384 | 9/2010 |
| JP | 2013215910 | 10/2013 |
| JP | 2015020398 | 2/2015 |
| JP | 2015024594 | 2/2015 |
| JP | 2015217593 | 12/2015 |

* cited by examiner

LIQUID EJECTING APPARATUS AND METHOD OF MAINTAINING LIQUID EJECTING APPARATUS

The present application is based on, and claims priority from JP Application Serial Number 2018-203699, filed Oct. 30, 2018, the disclosure of which is hereby incorporated by reference herein in its entirety.

BACKGROUND

1. Technical Field

The present disclosure relates to a liquid ejecting apparatus such as a printer and a method of maintaining the liquid ejecting apparatus.

2. Related Art

A liquid ejecting apparatus for drawing that discharges a functional liquid, which is an example liquid, from nozzles of a functional liquid discharge head, which is an example liquid ejector, to perform drawing on a substrate is provided, for example, in JP-A-2008-80209. The liquid ejecting apparatus includes a suction portion for sucking the functional liquid from the nozzles in a state in which an upper end, which is an example lip portion of a head cap, which is an example cap, is in contact with a nozzle surface. The liquid ejecting apparatus includes a supply portion for supplying a cleaning liquid, which is an example cleaning liquid, into the head cap.

The supply portion and the suction portion fill the inside of the head cap with the cleaning liquid and discharge the cleaning liquid in the head cap to clean the head cap. However, the functional liquid adhered to the upper end of the head cap cannot be cleaned.

Such a problem may occur not only in the liquid ejecting apparatus having the head cap but also occur in liquid ejecting apparatuses having a cap.

SUMMARY

According to an aspect of the present disclosure, a liquid ejecting apparatus includes a liquid ejector having a nozzle surface having nozzles from which a liquid is to be ejected, a cap configured to perform, when the cap comes into contact with the nozzle surface, capping for covering a space in which the nozzles are open, a capping mechanism configured to move the cap between a capping position for the capping and a separated position separated from the nozzle surface, a cleaning-liquid supply mechanism configured to supply a cleaning liquid into the cap, a facing portion configured to face a lip portion of the cap coming into contact with the nozzle surface in the capping, and a controller configured to control the capping mechanism and the cleaning-liquid supply mechanism such that the lip portion faces the facing portion and a predetermined space is provided between the lip portion and the facing portion for the cleaning liquid supplied in the cap to come into contact with the facing portion.

According to another aspect of the present disclosure, there is provided a method of maintaining a liquid ejecting apparatus including a liquid ejector having a nozzle surface having nozzles from which a liquid is to be ejected, a cap configured to perform capping for covering a space in which the nozzles are open when the cap comes into contact with the nozzle surface, a capping mechanism configured to move the cap between a capping position for the capping and a separated position separated from the nozzle surface, a cleaning-liquid supply mechanism configured to supply a cleaning liquid into the cap, and a facing portion configured to face a lip portion of the cap coming into contact with the nozzle surface in the capping. The method includes making the lip portion and the facing portion face each other and providing a predetermined space between the lip portion and the facing portion for the cleaning liquid supplied in the cap to come into contact with the facing portion.

DESCRIPTION OF EXEMPLARY EMBODIMENTS

Hereinafter, embodiments of a liquid ejecting apparatus and a method of maintaining the liquid ejecting apparatus will be described with reference to the attached drawings. The liquid ejecting apparatus according to an embodiment is an ink jet printer for printing images such as characters and photographs on a medium such as recording paper by ejecting an ink, which is an example liquid.

Figure 1:
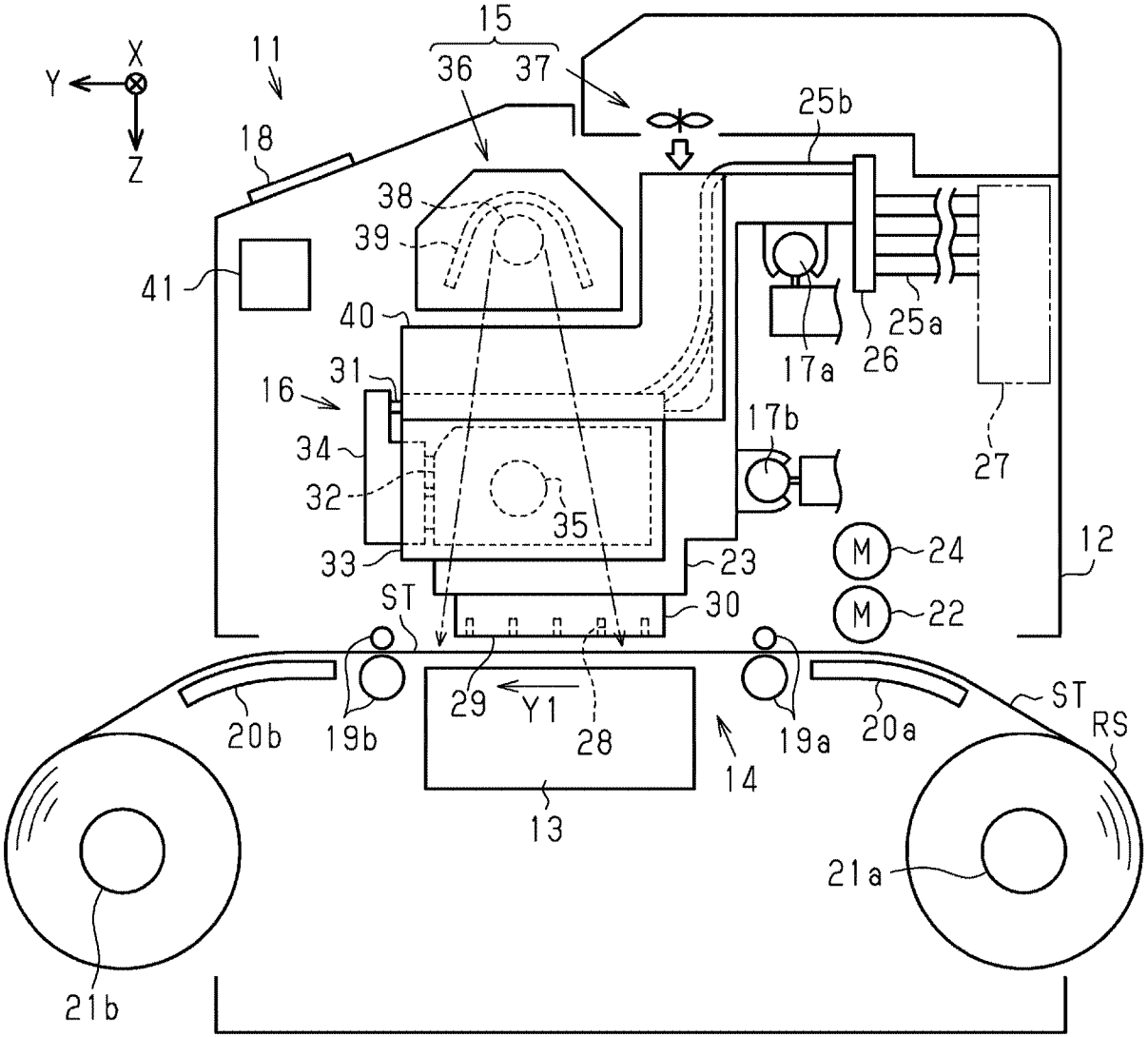
FIG. 1 is a schematic view of a liquid ejecting apparatus according to an embodiment.

As illustrated in FIG. 1, a liquid ejecting apparatus 11 includes a casing 12, a support base 13, a transport unit 14, a drying unit 15, a print unit 16, a first guide shaft 17*a*, and a second guide shaft 17*b*. The casing 12 accommodates components such as the support base 13, the drying unit 15, and the print unit 16. The support base 13, the first guide shaft 17*a*, and the second guide shaft 17*b* extend in an X-axis direction, which is a width direction of a medium ST.

The liquid ejecting apparatus 11 according to the embodiment includes an informing section 18 for displaying an operation state of the liquid ejecting apparatus 11. The informing section 18 displays an operation state of the liquid ejecting apparatus 11 to inform the user of the operation state of the liquid ejecting apparatus 11. The informing section 18 according to the embodiment is attached to the casing 12. The informing section 18 may be configured to operate the liquid ejecting apparatus 11 via a screen displaying an operation state. The informing section 18 includes, for example, a display screen for displaying information and buttons for operation.

The support base 13 supports a medium ST. The transport unit 14 transports the sheet-like medium ST from upstream to downstream in a transport direction Y1. The print unit 16 performs printing on the medium ST by using a liquid. The print unit 16 ejects the liquid toward the medium ST being transported at a print position set on the support base 13. A Y-axis direction corresponds to the transport direction Y1 of the medium ST at the print position. The drying unit 15 promotes the drying of the liquid adhered to the medium ST. The X axis and the Y axis intersect a Z axis. In this embodiment, a Z-axis direction is the direction of gravity and the direction of liquid ejection.

The transport unit 14 according to the embodiment includes a first transport roller pair 19*a*, a first guide plate 20*a*, and a supply reel 21*a*, which are disposed upstream of the support base 13 in the transport direction Y1. The transport unit 14 according to the embodiment includes a second transport roller pair 19*b*, a second guide plate 20*b*, and a winding reel 21*b*, which are disposed downstream of the support base 13 in the transport direction Y1. The transport unit 14 includes a transport motor 22 for rotating the first transport roller pair 19*a* and the second transport roller pair 19*b*.

In this embodiment, the medium ST is fed from a roll sheet RS that is wound around the supply reel 21*a* in a rolled state. The first transport roller pair 19*a* and the second transport roller pair 19*b* rotate while nipping the medium ST, and thereby transporting the medium ST along the surfaces of the first guide plate 20*a*, the support base 13, and the second guide plate 20*b*. The printed medium ST is wound by the winding reel 21*b*. The medium ST is not limited to the medium ST that is fed from the roll sheet RS but may be single sheets of medium ST.

The print unit 16 according to the embodiment includes a carriage 23 and a carriage motor 24. The carriage 23 is supported by the first guide shaft 17*a* and the second guide shaft 17*b*. The carriage 23 reciprocates along the first guide shaft 17*a* and the second guide shaft 17*b* above the support base 13 with a driving force of the carriage motor 24.

The liquid ejecting apparatus 11 includes a plurality of first supply tubes 25*a* that can be deformed to follow the carriage 23 that is reciprocating and a connection section 26 that is attached to the carriage 23. An upstream end of the first supply tube 25*a* is connected to a liquid supply source 27. A downstream end of the first supply tube 25*a* is connected to the connection section 26. The liquid supply source 27 may be a tank that can be refilled with the liquid or a cartridge that is detachably attached to the casing 12.

The print unit 16 includes a liquid ejector 30 that has a nozzle surface 29 having nozzles 28 from which the liquid is ejected. The liquid ejector 30 is installed on the carriage 23 such that the nozzle surface 29 faces the support base 13 or the medium ST that is supported by the support base 13. The print unit 16 includes, as components held by the carriage 23, a liquid supply path 31, a storage section 32, a storage section holding member 33 for holding the storage section 32, and a flow path adapter 34 that is connected to the storage section 32. The liquid ejector 30 is held at a lower part of the carriage 23. The storage section 32 is held at an upper part of the carriage 23. The liquid supply path 31 supplies the liquid supplied from the liquid supply source 27 to the liquid ejector 30.

The storage section 32 temporarily stores the liquid between the liquid supply path 31 and the liquid ejector 30. The liquid ejecting apparatus 11 may include a plurality of storage sections 32. The storage sections 32 are provided at least for each type of liquid. The types of liquid include inks of different colors, storage liquids that contain no color materials, processing liquids for promoting the fixing of inks, and the like. When a plurality of storage sections 32 store different colors of inks respectively, color printing can be performed.

Examples of the colors of the color inks include cyan, magenta, yellow, black, and white. Color printing may be performed by using four colors of cyan, magenta, yellow, and black, or three colors of cyan, magenta, and yellow. Color printing may be performed, in addition to the three colors of cyan, magenta, and yellow, by using at least one of light cyan, light magenta, light yellow, orange, green, gray, and the like. Each ink may contain a preservative.

The white ink can be used for background printing, which is performed before color printing, in performing printing on a medium ST that is a transparent or translucent film, or a medium ST of a dark color. The background printing may also be called solid printing or fill printing.

The storage section 32 includes a differential pressure valve 35. The differential pressure valve 35 is a so-called pressure reducing valve. Specifically, the differential pressure valve 35 opens when a liquid pressure between the differential pressure valve 35 and the liquid ejector 30 falls below a predetermined negative pressure, which is lower than atmospheric pressure, due to the liquid consumption in the liquid ejector 30. While opening, the differential pressure valve 35 allows the liquid to flow from the storage section 32 toward the liquid ejector 30.

The differential pressure valve 35 closes when the liquid pressure between the differential pressure valve 35 and the liquid ejector 30 returns to the predetermined negative pressure due to the flow of the liquid from the storage section 32 toward the liquid ejector 30. While closing, the differential pressure valve 35 stops the flow of the liquid from the storage section 32 toward the liquid ejector 30. The differential pressure valve 35 does not open even if the liquid pressure between the differential pressure valve 35 and the liquid ejector 30 becomes high. The differential pressure valve 35 thus functions as a unidirectional valve, that is, a so-called check valve that allows the liquid to flow from the storage section 32 toward the liquid ejector 30 and prevents the liquid from flowing from the liquid ejector 30 toward the storage section 32.

The liquid supply path 31 includes a second supply tube 25*b* having an upstream end connected to the connection section 26. A downstream end of the second supply tube 25*b* is connected to the flow path adapter 34 at a position higher than the storage section 32. The liquid is supplied through the first supply tube 25*a*, the second supply tube 25*b*, and the flow path adapter 34 in this order to the storage section 32.

The drying unit 15 according to the embodiment includes a heat generation mechanism 36 and a blower mechanism 37. The heat generation mechanism 36 is located above the carriage 23. The liquid ejector 30 ejects a liquid toward a medium ST that is stopped on the support base 13 while the carriage 23 is reciprocating between the heat generation mechanism 36 and the support base 13.

The heat generation mechanism 36 includes a heat generation member 38 and a reflection plate 39, which extend in the X-axis direction. The heat generation member 38 is, for example, an infrared heater. The heat generation mechanism 36 emits radiant heat, which is heat from, for example, infrared rays, from the heat generation member 38 and heats a medium ST in an area indicated by the dashed dotted arrow in FIG. 1. The blower mechanism 37 blows air to the area to be heated by the heat generation mechanism 36 to promote the drying of the medium ST.

The carriage 23 may include a thermal insulation member 40 between the storage section 32 and the heat generation mechanism 36. The thermal insulation member 40 is used to reduce heat transfer from the heat generation mechanism 36. The thermal insulation member 40 is made of a heat conductive metal material such as stainless steel or aluminum. The thermal insulation member 40 may cover at least an upper surface of the storage section 32.

The liquid ejecting apparatus 11 includes a controller 41 for controlling various operations performed in the liquid ejecting apparatus 11. The controller 41 includes, for example, a computer and a processing circuit including a memory, and controls the transport motor 22 and the carriage motor 24 in accordance with a program stored in the memory.

Figure 2:
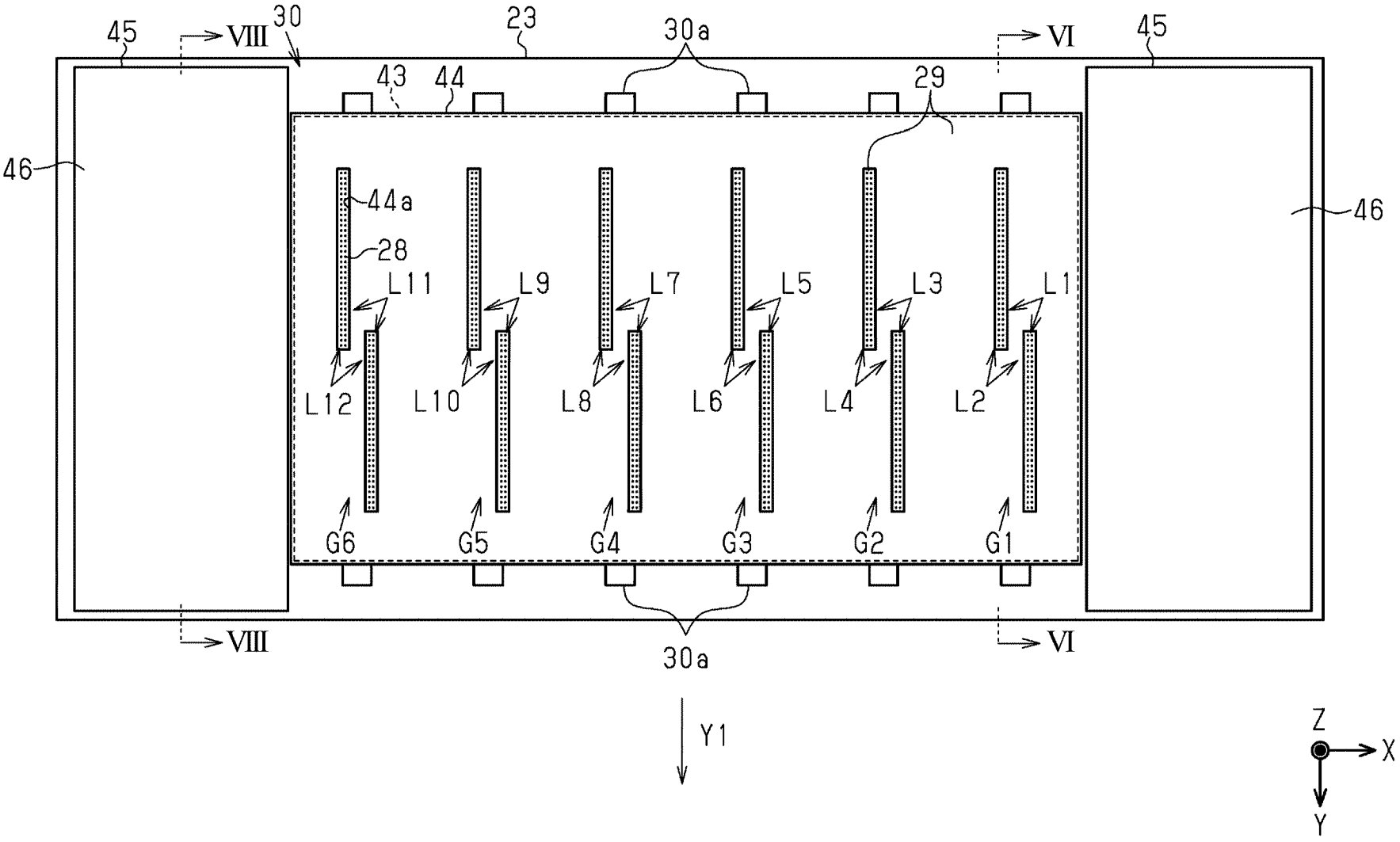
FIG. 2 is a schematic bottom view of a liquid ejector.

As illustrated in FIG. 2, the liquid ejector 30 includes a body 43 having the nozzles 28 and a cover 44 that covers a part of the body 43. The cover 44 is made of a metal such as stainless steel. The cover 44 has a plurality of through holes 44*a* that are open along the Z-axis direction in the cover 44. The cover 44 is fixed to the body 43 such that the nozzles 28 are exposed from the through holes 44*a*. The nozzle surface 29 includes the body 43, which is exposed from the through holes 44*a*, and the cover 44.

The liquid ejector 30 has a plurality of openings of the nozzles 28 for ejecting a liquid, and the openings are located at certain intervals in one direction to form nozzle arrays. In this embodiment, the openings of the nozzles 28 are located along the transport direction Y1 and form a first nozzle array L1 to a twelfth nozzle array L12. The nozzles 28 forming one nozzle array eject the same type of liquid. Among the nozzles 28 forming one nozzle array, the nozzles 28 located upstream in the transport direction Y1 and the nozzles 28 located downstream in the transport direction Y1 are shifted in positions in the X-axis direction.

The first nozzle array L1 to the twelfth nozzle array L12 are closely located in the X-axis direction in pairs. In this embodiment, each of the closely located two nozzle arrays is referred to as a nozzle group. The liquid ejector 30 includes a first nozzle group G1 to a sixth nozzle group G6 that are disposed at certain intervals in the X-axis direction.

Specifically, the first nozzle group G1 includes the first nozzle array L1 for ejecting a magenta ink and the second nozzle array L2 for ejecting a yellow ink. The second nozzle group G2 includes the third nozzle array L3 for ejecting a cyan ink and the fourth nozzle array L4 for ejecting a black ink. The third nozzle group G3 includes the fifth nozzle array L5 for ejecting a light cyan ink and the sixth nozzle array L6 for ejecting a light magenta ink. The fourth nozzle group G4 includes the seventh nozzle array L7 and the eighth nozzle array L8 for ejecting a processing liquid. The fifth nozzle group G5 includes the ninth nozzle array L9 for ejecting a black ink and the tenth nozzle array L10 for ejecting a cyan ink. The sixth nozzle group G6 includes the eleventh nozzle array L11 for ejecting a yellow ink and the twelfth nozzle array L12 for ejecting a magenta ink.

The liquid ejector 30 has a plurality of convex portions 30*a* that protrude toward both sides in the transport direction Y1. In the convex portions 30*a*, two convex portions 30*a* disposed at the same positions in the X-axis direction constitute a pair respectively. The pairs of the convex portions 30*a* are disposed at the same intervals as the nozzle groups in the X-axis direction.

The liquid ejecting apparatus 11 may include an airflow regulation section 45 that is held on a lower part of the carriage 23. The airflow regulation section 45 may have a facing portion 46 that faces the support base 13 or a medium ST supported by the support base 13. The facing portion 46 is thus provided in the carriage 23 that holds the liquid ejector 30 and moves. The facing portion 46 may be located at the same position as the nozzle surface 29 comprising the cover 44 in the Z-axis direction. The airflow regulation sections 45 disposed on both sides of the liquid ejector 30 in the X-axis direction contribute to the regulation of airflow around the liquid ejector 30 reciprocating in the X-axis direction. Both ends of the facing portions 46 in the transport direction Y1 are located outside the convex portions 30*a*.

Figure 3:
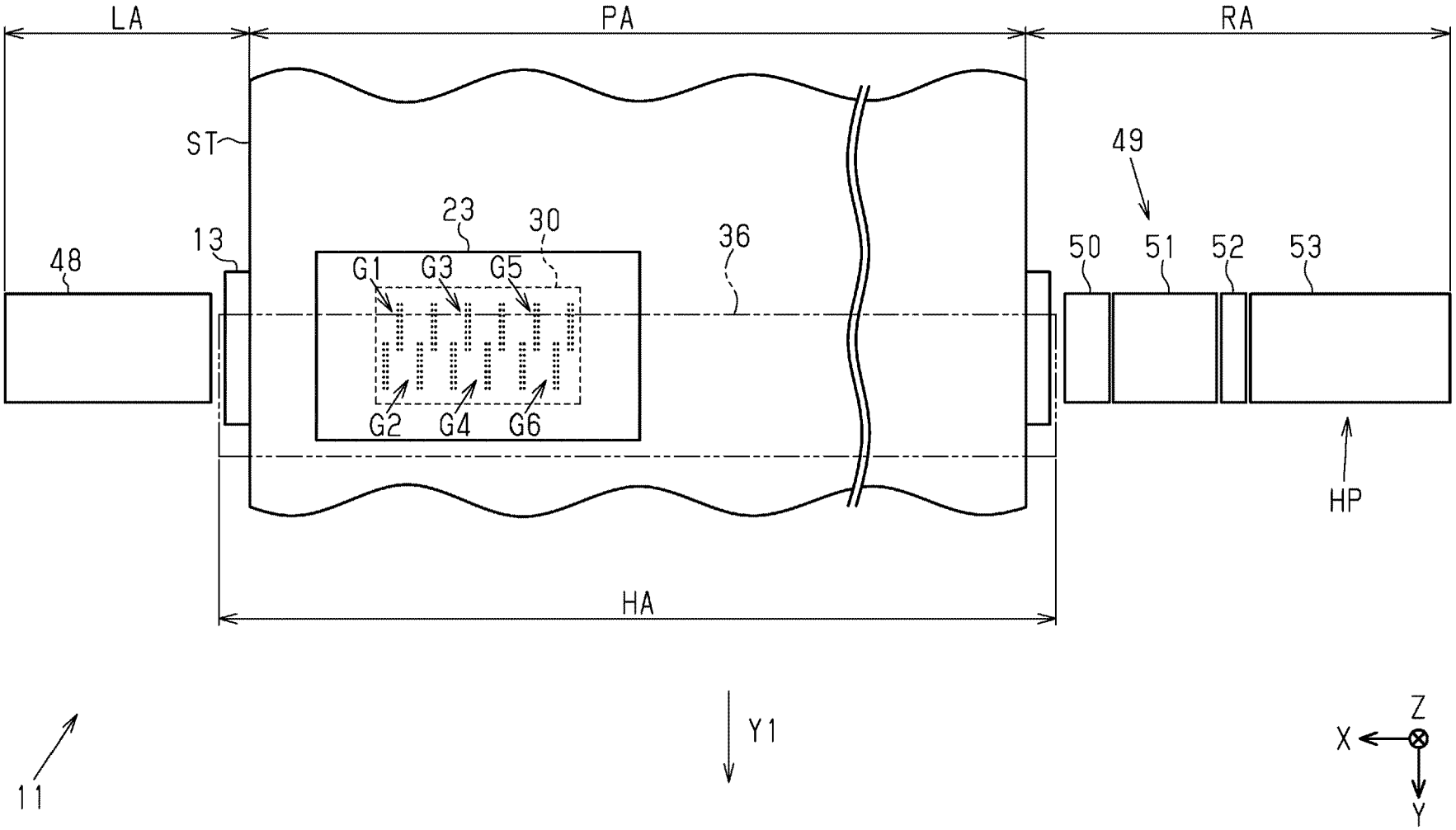
FIG. 3 is a schematic plan view illustrating an arrangement of components of a liquid ejecting apparatus.

As illustrated in FIG. 3, a movement area in which the liquid ejector 30 can move along the X-axis direction includes a printing area PA for printing on a medium ST, and a first non-printing area LA and a second non-printing area RA outside the printing area PA. The first non-printing area LA and the second non-printing area RA are located outside both ends of the printing area PA in the X-axis direction respectively. In the printing area PA, to a medium ST of a maximum width, the liquid ejector 30 can eject liquid. When the print unit 16 has a borderless printing function, the printing area PA is an area slightly wider in the X-axis direction than the medium ST of the maximum width. A heating area HA in which the heat generation mechanism 36 heats the medium ST overlaps the printing area PA.

The liquid ejecting apparatus 11 includes a moisture retention device 48 disposed in the first non-printing area LA and a maintenance unit 49 disposed in the second non-printing area RA. The maintenance unit 49 includes, in order from a component closer to the printing area PA, a flushing mechanism 50, a wiping mechanism 51 for wiping the nozzle surface 29, a suction mechanism 52, and a standby mechanism 53. A position above the standby mechanism 53 is a home position HP for the liquid ejector 30. From the home position HP, the liquid ejector 30 starts the movement.

Figure 4:
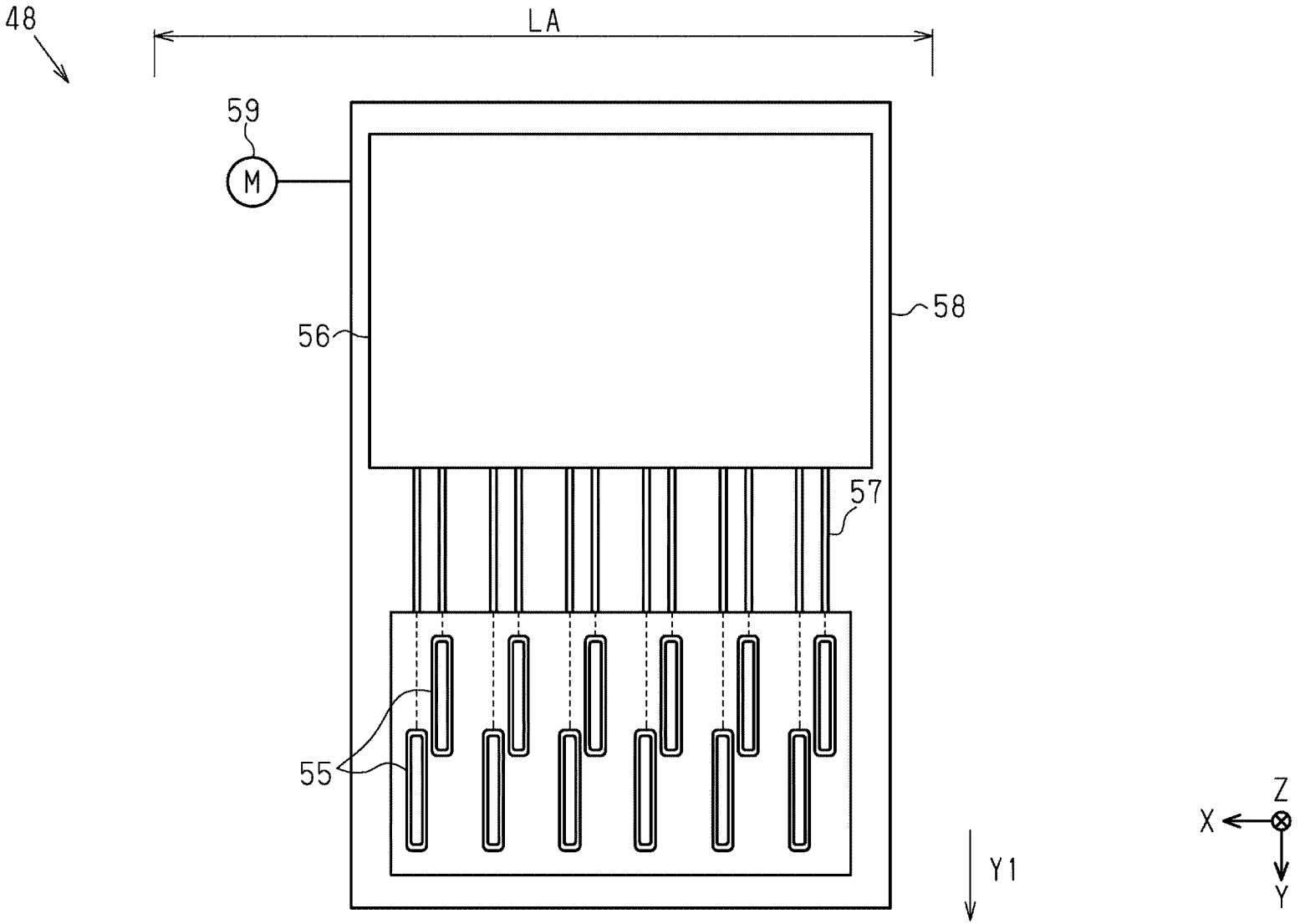
FIG. 4 is a schematic plan view illustrating a moisture retention device.

Now, the moisture retention device 48 will be described. As illustrated in FIG. 4, the moisture retention device 48 includes moisture retention caps 55, a moisture retention liquid supply section 56, connection flow paths 57, a holder 58, and a moisture-retention motor 59 for moving the holder 58 up or down. The connection flow path 57 connects the moisture retention cap 55 and the moisture retention liquid supply section 56. The moisture retention liquid supply section 56 supplies a moisture retention liquid into the moisture retention caps 55 via the connection flow paths 57. The holder 58 holds the moisture retention caps 55 and the moisture retention liquid supply section 56.

Moving the holder 58 up or down by the moisture-retention motor 59 moves the moisture retention caps 55 and the moisture retention liquid supply section 56 together. With this operation, the moisture retention caps 55 are moved between a contact position at which the moisture retention caps 55 come into contact with the liquid ejector 30 and a retracted position at which the moisture retention caps 55 are separated from the liquid ejector 30.

When the liquid ejector 30 is stopped in the first non-printing area LA, the moisture retention caps 55 are moved to the contact position and come into contact with the liquid ejector 30 so as to cover the openings of the nozzles 28. The maintenance operation of covering the nozzles 28 with the moisture retention caps 55 is referred to as moisture retention capping. The moisture retention capping is a kind of capping. The moisture retention capping suppresses the drying of the nozzles 28.

Hereinafter, the flushing mechanism 50, the wiping mechanism 51, the suction mechanism 52, and the standby mechanism 53 in the maintenance unit 49 will be described.

Figure 5:
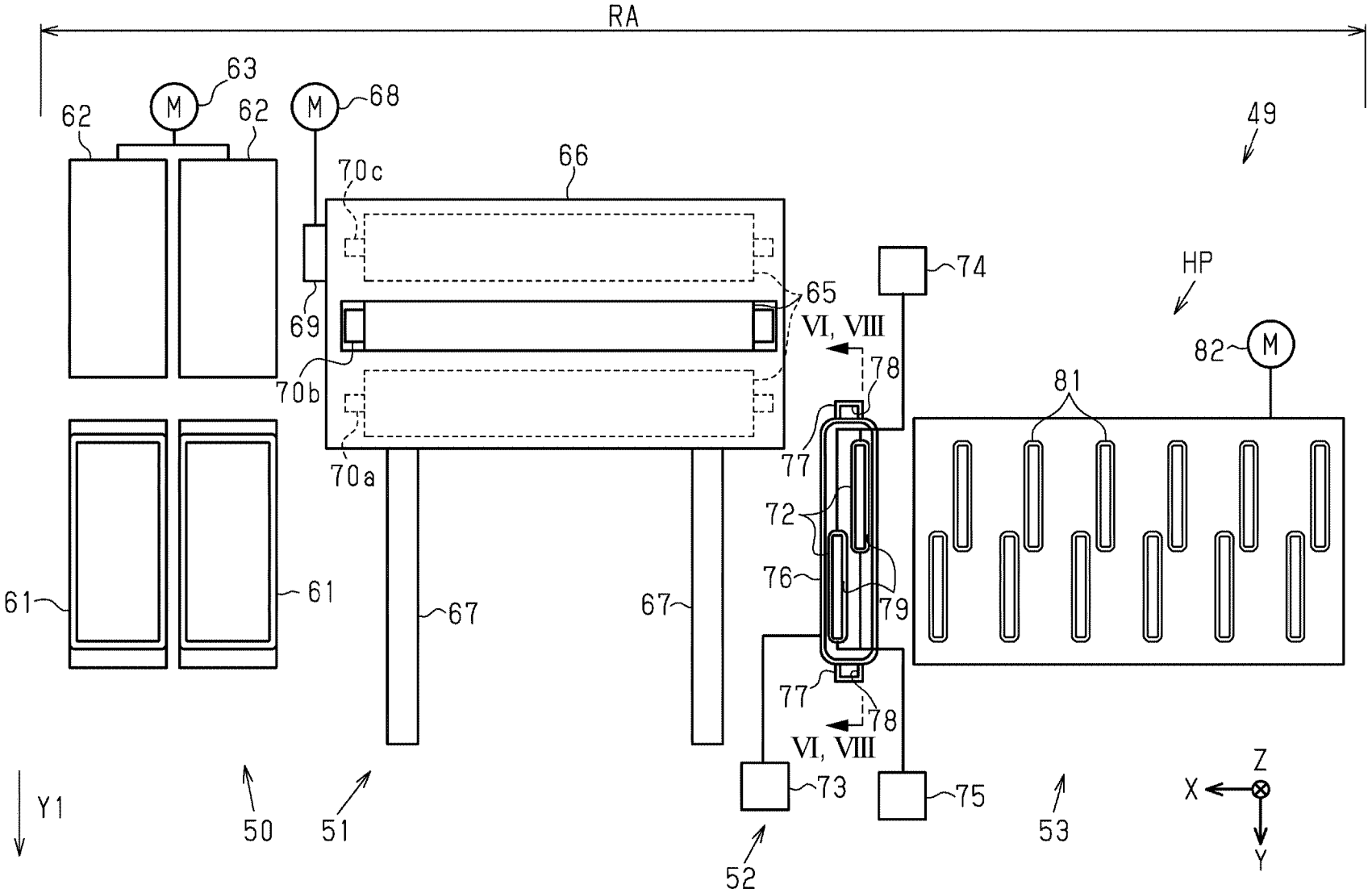
FIG. 5 is a schematic plan view illustrating a maintenance unit.

As illustrated in FIG. 5, the flushing mechanism 50 includes a liquid receiving section 61 for receiving liquid ejected by the liquid ejector 30 for flushing, a cover member 62 for covering the opening of the liquid receiving section 61, and a cover motor 63 for moving the cover member 62. The flushing is a maintenance process of ejecting liquid as waste liquid performed by the liquid ejector 30 to prevent or solve clogging of the nozzles 28. The flushing mechanism 50 may include a plurality of liquid receiving sections 61 and a plurality of cover members 62. The liquid ejector 30 may select a liquid receiving section 61 depending on the type of liquid. In this embodiment, the liquid receiving section 61 on the printing area PA side receives a plurality of color inks ejected by the liquid ejector 30 in a flushing operation, and the liquid receiving section 61 on the wiping mechanism 51 side receives a processing liquid ejected by the liquid ejector 30 in a flushing operation. The liquid receiving section 61 may store a moisture retention liquid.

The cover member 62 is moved by the cover motor 63 between a closed position in which the opening of the liquid receiving section 61 is covered and an open position in which the opening of the liquid receiving section 61 is exposed. When the flushing operation is not performed, the cover member 62 is moved to the closed position to prevent the drying of the stored moisture retention liquid and the received liquid.

The wiping mechanism 51 includes a sheet-type wiping member 65 for wiping the liquid ejector 30, a case 66 that accommodates the wiping member 65, a pair of rails 67 that extends along the transport direction Y1, and a wiping motor 68 for moving the case 66. The case 66 includes a power transmission mechanism 69 for transmitting the power of the wiping motor 68. The power transmission mechanism 69 is, for example, a rack and pinion mechanism. The case 66 reciprocates on the rails 67 in the transport direction Y1 by the power of the wiping motor 68.

The case 66 rotatably supports a feeding shaft 70*a*, a pressure roller 70*b*, and a winding shaft 70*c*. The case 66 has an opening above the pressure roller 70*b*. The feeding shaft 70*a* feeds the wiping member 65, and the wiping shaft 70*c* winds the used wiping member 65. The pressure roller 70*b* presses the wiping member 65 between the feeding shaft 70*a* and the winding shaft 70*c* so as to protrude the wiping member 65 from the opening of the case 66.

By the forward rotation of the wiping motor 68, the case 66 is moved downstream from an upstream position in the transport direction Y1 illustrated in FIG. 5 to a downstream position. Then, by the reverse rotation of the wiping motor 68, the case 66 is moved from the downstream position to the upstream position. The wiping member 65 may wipe the liquid ejector 30 at least in one of the processes of moving the case 66 from the upstream position to the downstream position and moving the case 66 from the downstream position to the upstream position. The wiping is a maintenance process of wiping performed by the wiping member 65.

The power transmission mechanism 69 may disconnect the wiping motor 68 and the winding shaft 70*c* when the wiping motor 68 rotates forward and connect the wiping motor 68 and the winding shaft 70*c* when the wiping motor 68 rotates reversely. The winding shaft 70*c* may be rotated by the power of the reversely rotating wiping motor 68. The winding shaft 70*c* may wind the wiping member 65 when the case 66 is moved from the downstream position toward the upstream position.

The suction mechanism 52 includes suction caps 72, which are example caps for performing a suction cleaning operation, and a capping mechanism 73 for reciprocating the suction caps 72 in the Z-axis direction. The suction mechanism 52 includes a cleaning-liquid supply mechanism 74 for supplying a cleaning liquid into the suction caps 72 and a discharge mechanism 75 for discharging liquid in the suction caps 72.

When a liquid to be ejected by the liquid ejector 30 is a water-based ink, the cleaning liquid may be pure water, or may be water containing an additive such as a preservative, a surfactant, or a moisture retention agent. When the liquid to be ejected by the liquid ejector 30 is a solvent ink, the cleaning liquid may be a solvent.

The suction cap 72 may cover all nozzles 28 or at least one nozzle group, or may cover some of the nozzles 28 in the nozzle group. The suction mechanism 52 according to the embodiment includes the suction cap 72 that corresponds to the nozzles 28 disposed on the upstream side in the transport direction Y1 among the nozzles 28 constituting one nozzle group and the suction cap 72 that corresponds to the nozzles 28 disposed on the downstream side in the transport direction Y1. The suction mechanism 52 may include a tub 76 for accommodating the two suction caps 72. Protrusions 77 may be provided on both sides of the tub 76 in the transport direction Y1. The protrusion 77 may have a concave portion 78 having an upper opening.

Figure 6:
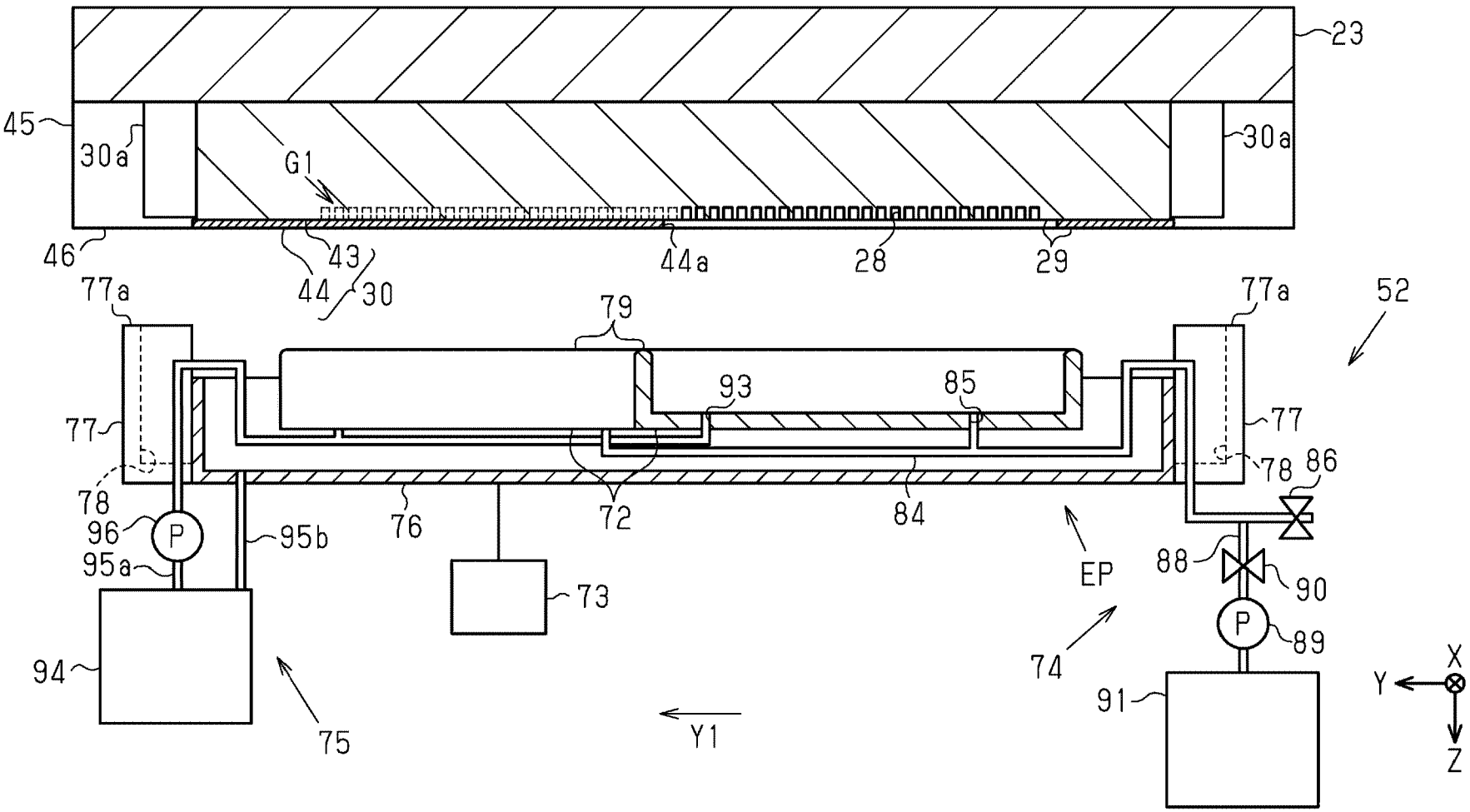
FIG. 6 is a cross-sectional view taken along the line VI-VI in FIG. 2 and the line VI-VI in FIG. 5.
Figure 7:
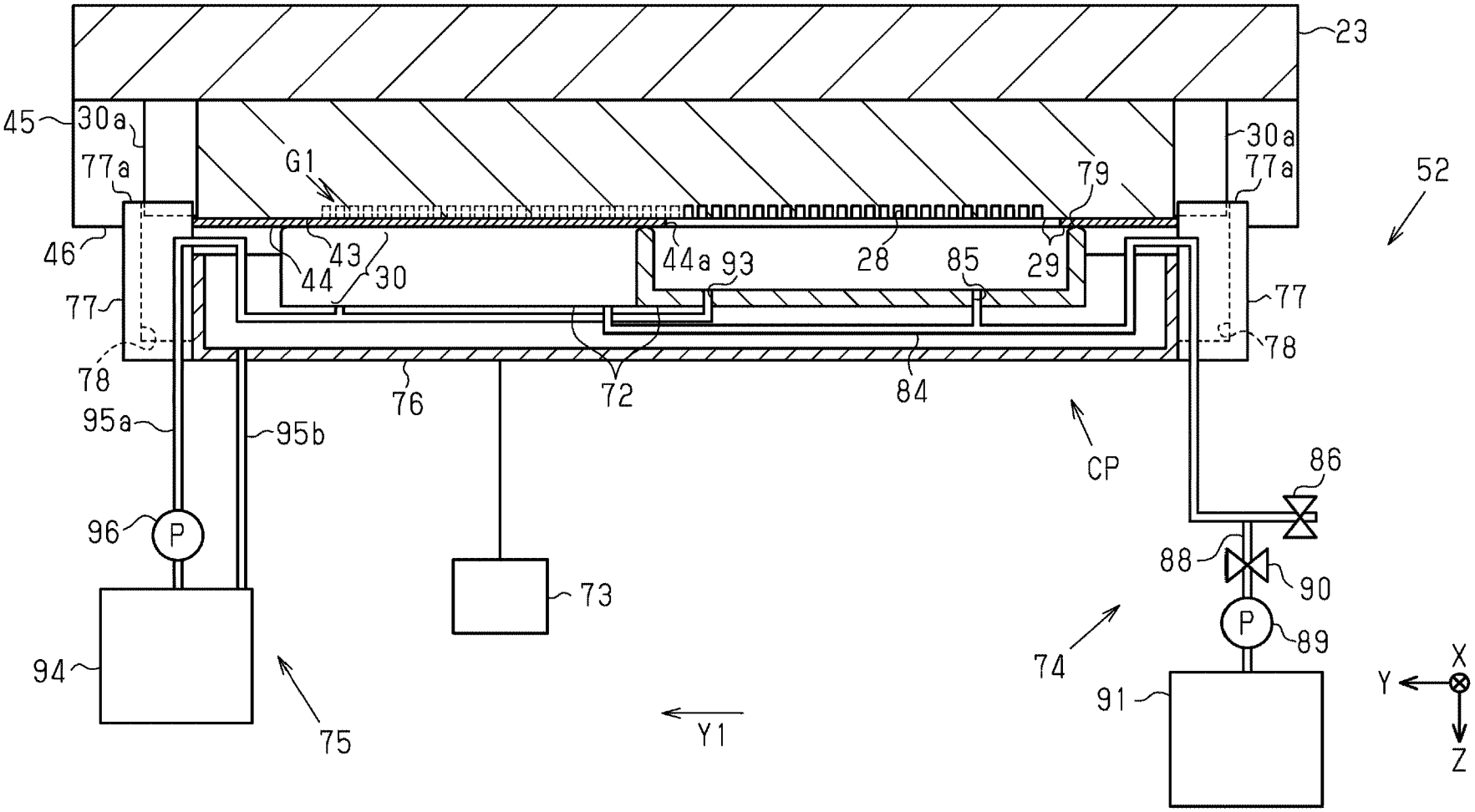
FIG. 7 is a schematic view illustrating a suction mechanism in a capping position.

When the suction cap 72 is located at a capping position CP illustrated in FIG. 7 and brought into contact with the nozzle surface 29, the suction cap 72 performs capping for covering space in which the nozzles 28 open. The capping mechanism 73 moves the suction caps 72 between the capping position CP for capping and a separated position EP illustrated in FIG. 6 where the suction caps 72 are separated from the nozzle surface 29.

The suction cap 72 has a lip portion 79 that comes into contact with the nozzle surface 29 in a capping operation. The lip portion 79 is an annular upper end of the suction cap 72, and has an upper opening. The liquid repellency of the surface of the lip portion 79 may be higher than the liquid repellency of the surface of the facing portion 46. Specifically, a contact angle between the surface of the facing portion 46 and liquid droplets of the cleaning liquid may be smaller than a contact angle between the surface of the lip portion 79 and liquid droplets of the cleaning liquid.

The standby mechanism 53 includes standby caps 81 and a standby motor 82 for moving the standby caps 81. The standby cap 81 is moved between a contact position and a retracted position by the power of the standby motor 82. At the contact position, the standby caps 81 come into contact with the liquid ejector 30. At the retracted position, the standby caps 81 are separated from the liquid ejector 30.

The standby mechanism 53 according to the embodiment includes twelve standby caps 81. One standby cap 81 corresponds to, among the nozzles 28 in one nozzle group, the nozzles 28 on the upstream side in the transport direction Y1, or the nozzles 28 on the downstream side in the transport direction Y1. The standby motor 82 moves the standby caps 81 together. When the liquid ejector 30 is stopped at the home position HP, the standby caps 81 are moved from the retracted position to the contact position and comes into contact with the nozzle surface 29. By the operation, the standby caps 81 cover the openings of the nozzles 28 in the first nozzle group G1 to the sixth nozzle group G6. The maintenance operation of covering the openings of the nozzles 28 by the standby caps 81 is referred to as standby capping. The standby capping is a kind of capping. The standby capping suppresses the drying of the nozzles 28.

Now, the suction cap 72 will be described. FIG. 6 and FIG. 7 illustrate the first nozzle group G1 located above the suction caps 72. FIG. 6 and FIG. 7 are combinations of the cross-sectional views taken along the lines VI-VI in FIG. 2 and the line VI-VI in FIG. 5. The suction mechanism 52 according to the embodiment includes two suction caps 72. The suction caps 72 have the same structure. In the following description, accordingly, one of the suction caps 72 will be described and the description of the other suction cap 72 will be omitted.

As illustrated in FIG. 6, the lip portion 79 may be located below an upper end 77*a* of the protrusion 77 in the Z-axis direction. In the suction cap 72, a communication portion 85 that communicates with an open flow path 84 may be provided. The open flow path 84 may be provided for each suction cap 72, or one open flow path 84 may communicate with a plurality of suction caps 72. The open flow path 84 is provided with an air release valve 86. The air release valve 86 that is open while the suction cap 72 is capping the nozzle surface 29 allows the air in the suction cap 72 to communicate with the atmosphere outside the suction cap 72. Consequently, opening the air release valve 86 allows the air in the suction cap 72 to be released to the atmosphere.

The cleaning-liquid supply mechanism 74 includes a supply flow path 88, a supply pump 89 and a supply valve 90 that are disposed in the supply flow path 88. An upstream end of the supply flow path 88 is connected to a container 91 for storing a cleaning liquid. A downstream end of the supply flow path 88 is connected to the open flow path 84 between the suction cap 72 and the air release valve 86. The cleaning-liquid supply mechanism 74 supplies a cleaning liquid into the suction cap 72 via the open flow path 84 and the communication portion 85.

In the suction cap 72, a discharge portion 93 to which the discharge mechanism 75 is connected is open. The discharge mechanism 75 includes a first discharge flow path 95*a* that connects the discharge portion 93 and a waste liquid tank 94, a second discharge flow path 95*b* that connects the tub 76 and the waste liquid tank 94, and a discharge pump 96 that is disposed in the first discharge flow path 95*a*. The first discharge flow path 95*a* may be provided for each suction cap 72, or one first discharge flow path 95*a* may be branched and connected to a plurality of suction caps 72. The open flow path 84, the supply flow path 88, the first discharge flow path 95*a*, and the second discharge flow path 95*b* may be, for example, tubes. The supply pump 89 and the discharge pump 96 may be, for example, tube pumps.

Hereinafter, suction cleaning for the liquid ejector 30 will be described. The controller 41 performs a suction cleaning operation for each nozzle group in the liquid ejector 30. As illustrated in FIG. 6, the controller 41 drives the carriage motor 24 in a state in which the suction caps 72 are in the separated position EP to make the nozzle group to which the suction cleaning is to be performed and the suction cap 72 face each other. FIG. 6 illustrates the first nozzle group G1 and the suction caps 72 facing each other. The controller 41 drives the capping mechanism 73 to move the suction caps 72 in the separated position EP to the capping position CP.

As illustrated in FIG. 7, when the capping mechanism 73 moves the suction caps 72 to the capping position CP, the convex portions 30*a* of the liquid ejector 30 are inserted into the concave portions 78 of the suction mechanism 52. The suction caps 72 are positioned in the X-axis direction and the Y-axis direction by the engagement of the convex portions 30*a* and the concave portions 78. When the suction caps 72 are positioned at the capping position CP, the lip portions 79 are in contact with the nozzle surface 29 and the inside of the suction caps 72 is sealed.

The controller 41 drives the discharge pump 96 with the air release valve 86 and the supply valve 90 being closed. The driven discharge pump 96 causes the suction caps 72 to generate a negative pressure inside the suction caps 72, and thereby the inside of the liquid ejector 30 is sucked. By the suctioning operation, the thickened liquid and/or bubbles in the liquid ejector 30 can be discharged from the nozzles 28 in the first nozzle group G1. The maintenance operation of discharging the liquid from the nozzles 28 by suction is referred to as suction cleaning.

To end the suction cleaning, the controller 41 opens the air release valve 86 to introduce air into the suction caps 72 to discharge the liquid in the suction caps 72 to the waste liquid tank 94. Then, the controller 41 drives the capping mechanism 73 to move the suction caps 72 from the capping position CP to the separated position EP.

As illustrated in FIG. 6, when the suction caps 72 are moved to the separated position EP, the lip portions 79 are separated from the nozzle surface 29. The convex portions 30*a* are disengaged from the concave portions 78. The controller 41 moves the carriage 23 to make the second nozzle group G2 and the suction caps 72 face each other. Then, the controller 41 moves the suction caps 72 from the separated position EP to the capping position CP to perform a suction cleaning operation to the second nozzle group G2.

In this manner, the controller 41 repeats the moving of the suction caps 72 between the capping position CP and the separated position EP, the opening and closing of the air release valve 86, the driving of the discharge pump 96, and the moving of the liquid ejector 30 from the second non-printing area RA toward the printing area PA along the X-axis direction, and thus the suction cleaning is performed for each of the first nozzle group G1 to the sixth nozzle group G6.

Now, lip cleaning for supplying a cleaning liquid to the suction caps 72 to clean the lip portion 79 will be described. As a result of a suction cleaning operation, sometimes the liquid adheres to the lip portion 79. To the lip portion 79, mist due to printing and/or foreign matter produced from a medium ST can adhere. The foreign matter produced from a medium ST may be referred to as paper powder when the medium ST is paper, or may be referred to as fluff when the medium ST is cloth. The lip portion 79 with foreign matter adhered or the lip portion 79 with thickened or solidified liquid or mist can reduce the sealing performance of the suction cap 72 in the capped state.

The controller 41 performs the lip cleaning to remove the foreign matter adhered to the lip portion 79. The controller 41 may perform the lip cleaning, for example, after the suction cleaning is performed, or when an ejection failure in the nozzles 28 is not solved even after performing the suction cleaning. The controller 41 may perform the lip cleaning when adherents on the lip portion 79 are detected, the power is turned on, the power is turned off, or the lip cleaning is performed.

Figure 8:
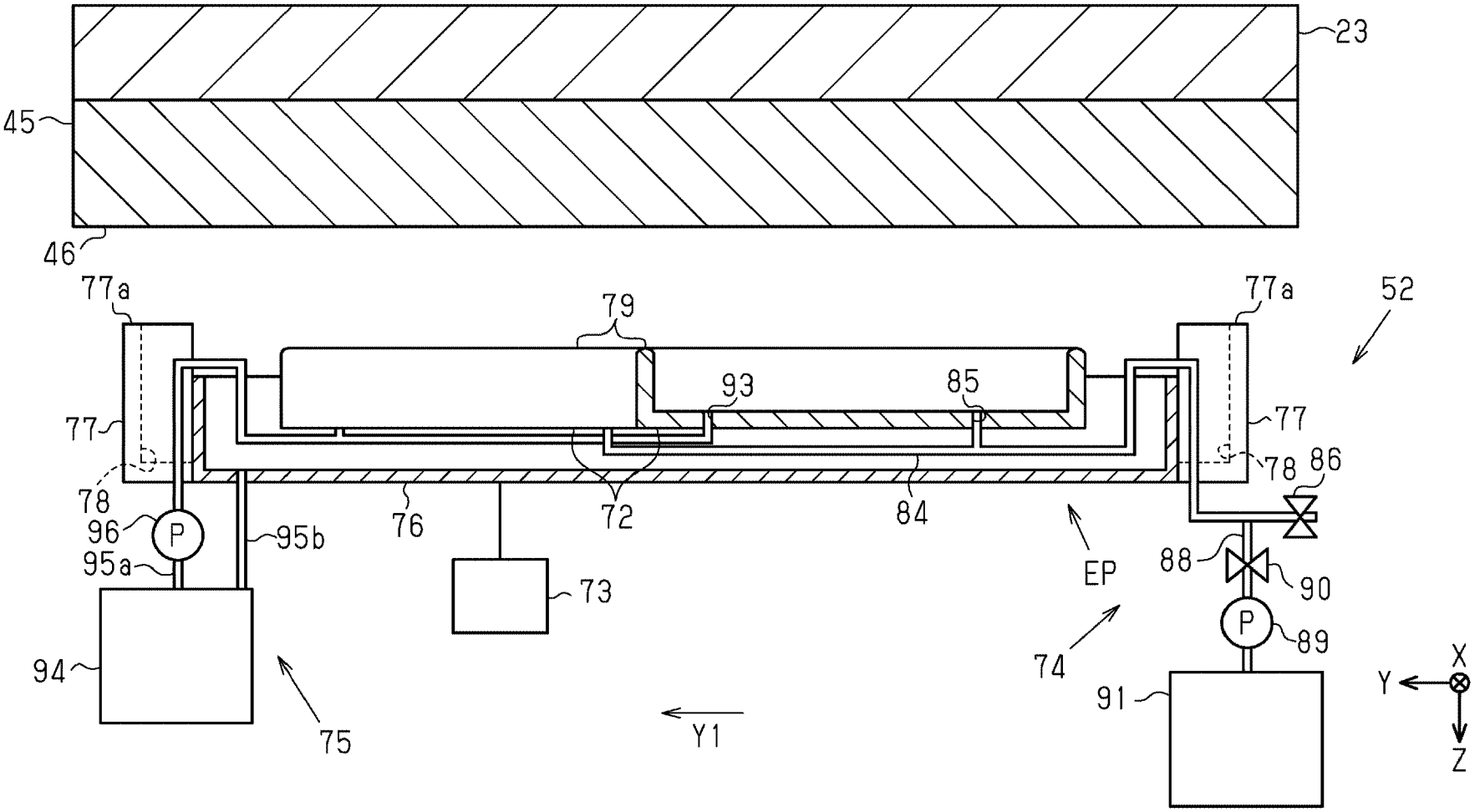
FIG. 8 is a cross-sectional view taken along the line VIII-VIII in FIG. 2 and the line VIII-VIII in FIG. 5.

FIG. 8 illustrates the facing portion 46 located above the suction mechanism 52. FIG. 8 is a combination of the cross-sectional views taken along the lines VIII-VIII in FIG. 2 and the line VIII-VIII in FIG. 5. As illustrated in FIG. 8, the controller 41 drives the carriage motor 24 in a state in which the suction caps 72 are in the separated position EP to make the airflow regulation section 45 on the side closer to the second non-printing area RA than the liquid ejector 30 when liquid ejector 30 is in the printing area PA and the suction caps 72 to face each other. The facing portion 46 is configured to face the lip portions 79. The controller 41 drives the capping mechanism 73 to move the suction caps 72 in the separated position EP upward toward the capping position CP.

Figure 9:
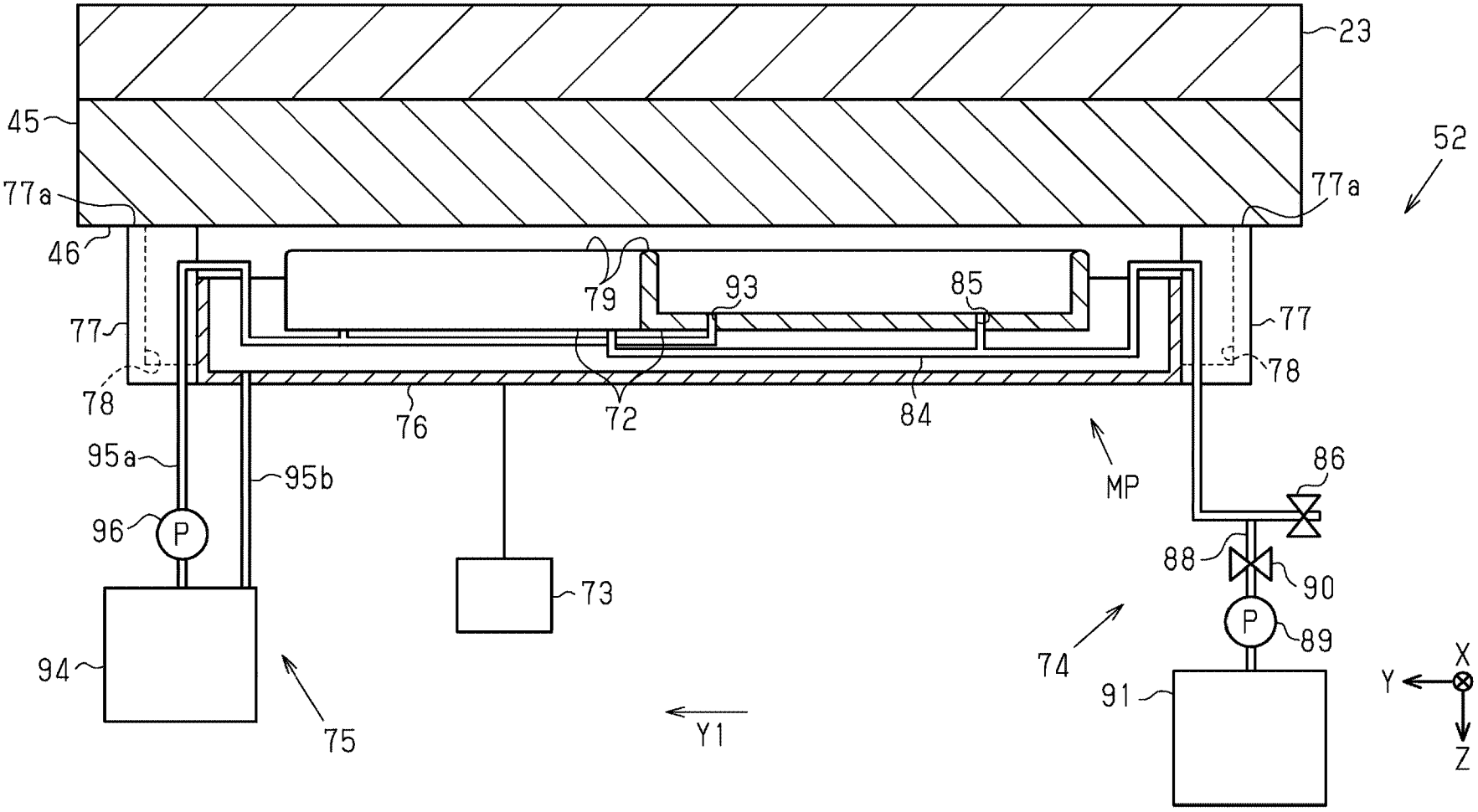
FIG. 9 is a schematic view illustrating a suction mechanism in a maintenance position.

As illustrated in FIG. 9, the position of the upper end 77*a* of the protrusion 77 is higher than the positions of the lip portions 79 and closer to the facing portion 46. With this structure, when the suction caps 72 in the separated position EP are moved toward the facing portion 46 in a state in which the facing portion 46 faces the suction caps 72, before the lip portions 79 come into contact with the facing portion 46, the protrusions 77 come into contact with the facing portion 46.

The position of the suction cap 72 when the protrusion 77 are in contact with the facing portion 46 is referred to as a maintenance position MP. The maintenance position MP is a position between the capping position CP and the separated position EP. When the suction cap 72 is in the maintenance position MP, the lip portions 79 face the facing portion 46 and a predetermined space is made between the lip portions 79 and the facing portion 46. The controller 41 opens the supply valve 90 while closing the air release valve 86, and drives the supply pump 89 to supply the cleaning liquid to the suction caps 72.

Figure 10:
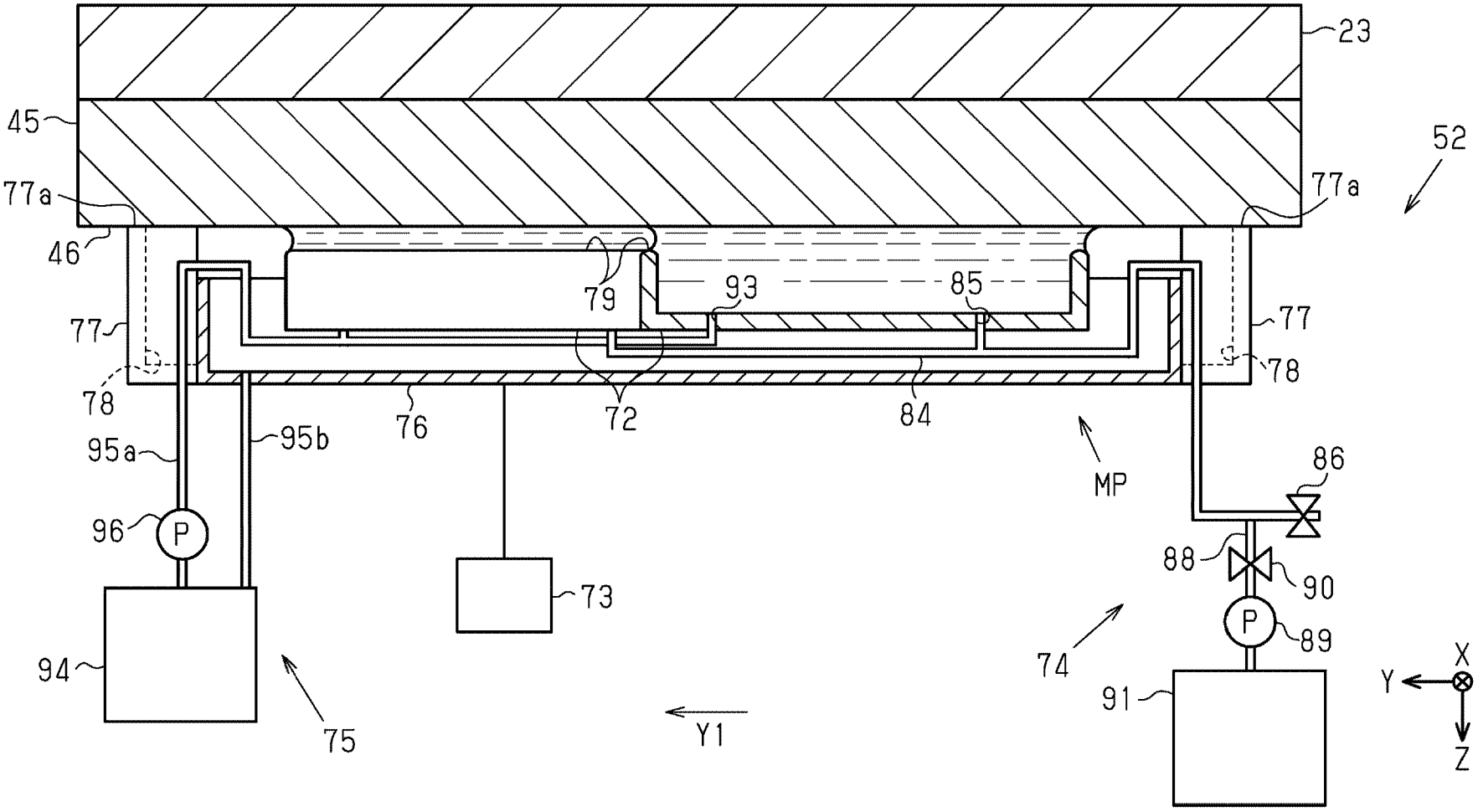
FIG. 10 is a schematic view illustrating a cleaning-liquid supply mechanism for supplying a cleaning liquid into a suction cap.

As illustrated in FIG. 10, the predetermined space between the lip portions 79 of the suction cap 72 in the maintenance position MP and the facing portion 46 is smaller than the space between the lip portions 79 of the suction caps 72 in the separated position EP and the facing portion 46. The predetermined space is a space the cleaning liquid in the suction caps 72 can come into contact with the nozzle surface 29 when the cleaning-liquid supply mechanism 74 supplies the cleaning liquid into the suction cap 72. The predetermined space is set in advance based on the size, shape, and wettability of the suction cap 72, a surface tension acting on the cleaning liquid, an amount of cleaning liquid supplied by the cleaning-liquid supply mechanism 74 per unit time, or the like.

For example, when the liquid repellency of the suction cap 72 is high or a cleaning liquid having a high surface tension is used, the cleaning liquid is held in a state the cleaning liquid forms a convex shape in the suction cap 72. On the other hand, when the liquid repellency of the suction cap 72 is low or a cleaning liquid having a low surface tension is used, the cleaning liquid flows out of the suction cap 72 while the convex portion of the cleaning liquid in the suction cap 72 is small. Accordingly, when the liquid repellency of the suction cap 72 is high or a cleaning liquid having a high surface tension is to be used, the cleaning liquid comes into contact with the nozzle surface 29 even if the space between the nozzle surface 29 and the lip portion 79 is increased. When the liquid repellency of the suction cap 72 is low or a cleaning liquid having a low surface tension is to be used, the space between the nozzle surface 29 and the lip portion 79 is to be reduced.

In this embodiment, the surfaces of the suction cap 72 and the lip portion 79 are made of an elastomer, and water containing a surfactant and having a low surface tension is supplied as a cleaning liquid. In this embodiment, the space between the lip portion 79 and the facing portion 46 when the suction cap 72 is in the maintenance position MP is 0.85 mm. For example, when water containing no surfactant and having a high surface tension is supplied as a cleaning liquid, the space between the lip portion 79 and the facing portion 46 may be 1 mm.

Figure 11:
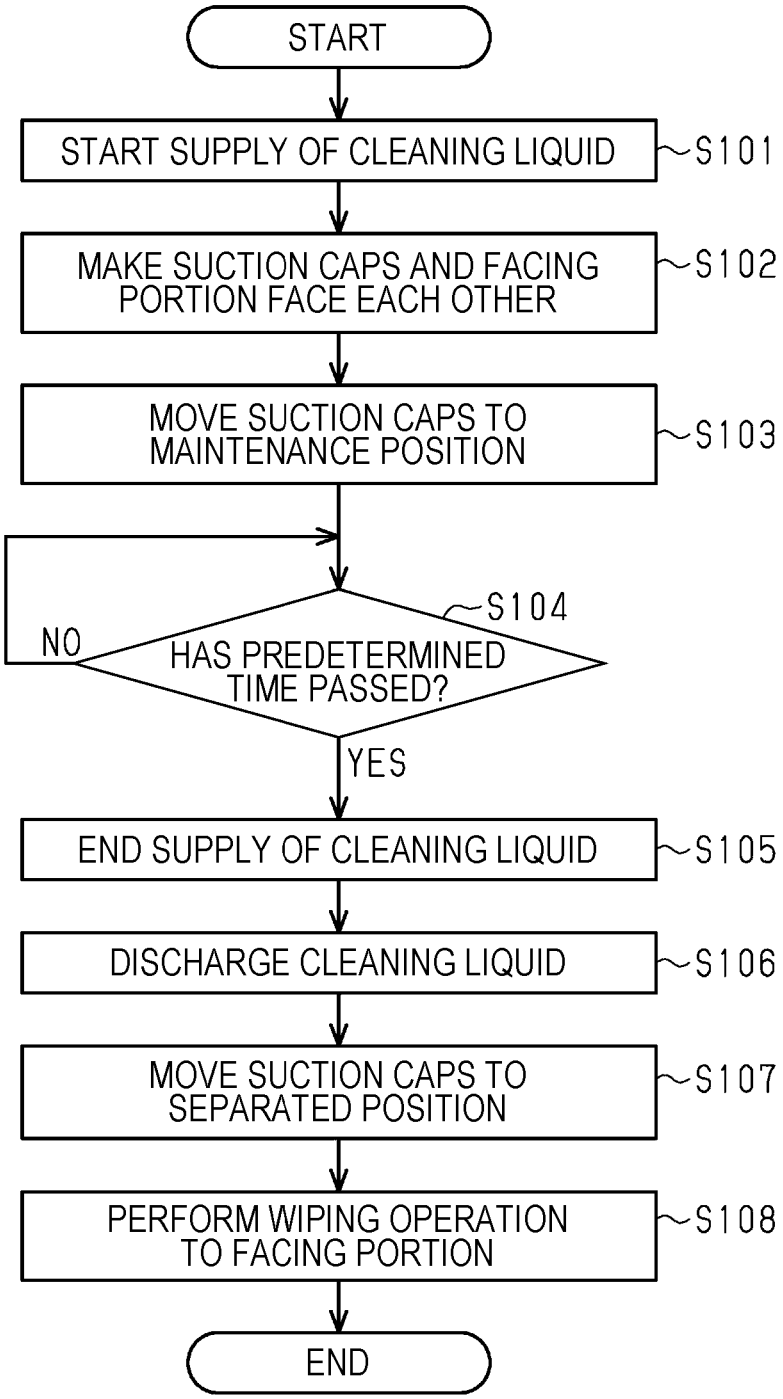
FIG. 11 is a flowchart illustrating a lip cleaning routine.

With reference to the flowchart in FIG. 11, a lip cleaning routine to be performed by the controller 41 in cleaning the lip portion 79 will be described. As illustrated in FIG. 11, in step S101, the controller 41 drives the supply pump 89 to start the supply of the cleaning liquid into the suction caps 72.

In step S102, the controller 41 drives the carriage motor 24 to move the carriage 23 such that the facing portion 46 faces the suction caps 72 in the separated position EP. With this operation, the controller 41 makes the lip portions 79 and the facing portion 46 face each other.

In step S103, the controller 41 drives the capping mechanism 73 to move the suction caps 72 in the separated position EP to the maintenance position MP. The controller 41 moves the suction caps 72 from the separated position EP toward the facing portion 46 so as to provide a predetermined space between the lip portions 79 and the facing portion 46. The controller 41 performs control such that the cleaning liquid supplied in the suction caps 72 comes into contact with the facing portion 46 with the predetermined space between the lip portions 79 and the facing portion 46.

In step S104, the controller 41 determines whether a predetermined time has passed since the start of the drive of the supply pump 89. The predetermined time is a time necessary for filling the suction caps 72 with the cleaning liquid and cleaning the lip portions 79. In particular, for example, when the supply pump 89 supplies the cleaning liquid at 10 ml per second to the suction cap 72 having a volume of 50 ml, the predetermined time is longer than five seconds. In step S104, when the predetermined time has not passed, step S104 is NO, and the controller 41 keeps driving the supply pump 89 until the predetermined time passes. In step S104, when the predetermined time has passed, step S104 is YES, and the controller 41 proceeds to step S105.

In step S105, the controller 41 stops the driving of the supply pump 89 to end the supply of the cleaning liquid. In step S106, the controller 41 drives the discharge pump 96 to discharge the cleaning liquid in the suction caps 72.

In step S107, the controller 41 drives the capping mechanism 73 to move the suction caps 72 from the maintenance position MP to the separated position EP. In step S108, the controller 41 performs a wiping operation to the facing portion 46 and ends the operation. In this operation, the controller 41 drives the carriage motor 24 to locate the facing portion 46 in the movement path of the wiping member 65. The controller 41 drives the wiping motor 68 and performs the wiping operation to the facing portion 46.

The operations according to the embodiment will be described. The controller 41 may start the supply of the cleaning liquid into the suction caps 72 before the predetermined space is provided between the lip portions 79 and the facing portion 46. The controller 41 according to the embodiment starts the supply of the cleaning liquid into the suction caps 72 before the lip portions 79 face the facing portion 46. The controller 41 may start the supply of the cleaning liquid after the lip portions 79 face the facing portion 46 and before the predetermined space is provided between the lip portions 79 and the facing portion 46.

As illustrated in FIG. 8, the controller 41 drives the carriage motor 24 to move the suction caps 72 in the separated position EP such that the lip portions 79 of the suction caps 72 face the facing portion 46, and drives the capping mechanism 73 to move the suction caps 72 from the separated position EP toward the facing portion 46. The controller 41 perform control to provide the predetermined space between the lip portions 79 and the facing portion 46. The controller 41 controls the capping mechanism 73 and the cleaning-liquid supply mechanism 74 to locate the suction caps 72 to the maintenance position MP such that the cleaning liquid supplied in the suction caps 72 comes into contact with the facing portion 46.

The controller 41 may supply the cleaning liquid such that the cleaning liquid spreads between the lip portions 79 and the facing portion 46 and the cleaning liquid is held in the suction caps 72. The cleaning liquid dissolve or soften the foreign matter adhered to the lip portions 79 to clean the lip portions 79. When a contact angle between the surface of the facing portion 46 and droplets of the cleaning liquid is smaller than a contact angle between the surface of the lip portion 79 and droplets of the cleaning liquid, the cleaning liquid in contact with the facing portion 46 within the suction cap 72 readily wets and spreads along the facing portion 46. Accordingly, the lip portions 79 can be readily wetted. After the controller 41 ends the supply of the cleaning liquid, the controller 41 may stand by with the cleaning liquid held in the suction caps 72 and the lip portions 79 wetted.

The controller 41 may supply the cleaning liquid to an extent that the cleaning liquid overflows the suction caps 72. The cleaning liquid overflowing the suction caps 72 clean the lip portions 79 and is received by the tub 76, and is stored in the waste liquid tank 94 via the second discharge flow path 95*b*. The controller 41 may keep supplying the cleaning liquid while cleaning the lip portions 79.

After the completion of the cleaning of the lip portions 79, the controller 41 may stop the driving of the supply pump 89 while driving the discharge pump 96 to discharge the cleaning liquid remaining in the suction caps 72. After the cleaning liquid supplied into the suction caps 72 is brought into contact with the facing portion 46, before a wiping operation for the facing portion 46 is performed by the wiping mechanism 51, the discharge mechanism 75 may discharge the cleaning liquid supplied in the suction caps 72. After the cleaning liquid in the suction caps 72 is discharged, the controller 41 may move the carriage 23 such that a wiping operation is performed to the facing portion 46 by the wiping mechanism 51.

Advantages of the embodiment will be described.

1. The cleaning-liquid supply mechanism 74 supplies the cleaning liquid into the suction caps 72 while the lip portions 79 faces the facing portion 46 with the predetermined space between the lip portions 79 and the facing portion 46. The cleaning liquid supplied in the suction caps 72 comes into contact with the facing portion 46. The lip portions 79 can be thus wetted and cleaned by the cleaning liquid.

2. The surface of the facing portion 46 has higher wettability than the surface of the lip portion 79. Accordingly, when the cleaning liquid supplied in the suction caps 72 comes into contact with the surface of the facing portion 46, the cleaning liquid readily wets and spreads to the outside of the suction caps 72 and the lip portions 79 can be readily cleaned.

3. The facing portion 46 is provided in the carriage 23 to which the liquid ejector 30 is mounted. With this structure, the carriage 23 can be moved such that the lip portions 79 and the facing portion 46 face each other.

4. The cleaning-liquid supply mechanism 74 starts the supply of the cleaning liquid before a predetermined space is provided between the lip portions 79 and the facing portion 46. With this operation, the time necessary to clean the lip portions 79 can be reduced as compared with, for example, a case in which the supply of the cleaning liquid is started by the cleaning-liquid supply mechanism 74 after the predetermined space is provided between the lip portions 79 and the facing portion 46.

5. After the lip portions 79 face the facing portion 46, the suction caps 72 in the separated position EP are moved from the separated position EP toward the facing portion 46 to provide the predetermined space between the lip portions 79 and the facing portion 46. Accordingly, the suction caps 72 in the separated position EP can be moved with a distance between the lip portions 79 and the facing portion 46 until the predetermined space is provided between the lip portions 79 and the facing portion 46.

6. The cleaning-liquid supply mechanism 74 starts the supply of the cleaning liquid before the lip portions 79 face the facing portion 46. Accordingly, the time necessary to clean the lip portions 79 can be reduced as compared with, for example, a case in which the supply of the cleaning liquid is started by the cleaning-liquid supply mechanism 74 after the lip portions 79 face the facing portion 46.

7. The wiping mechanism 51 for wiping the nozzle surface 29 performs a wiping operation to the facing portion 46. Accordingly, the number of components can be reduced as compared with a case in which the mechanism for wiping the nozzle surface 29 and the mechanism for wiping the facing portion 46 are separately provided.

8. When the suction caps 72 storing the cleaning liquid are moved, the cleaning liquid may be scattered and the inside of the liquid ejecting apparatus 11 may be contaminated. To solve the problem, the discharge mechanism 75 discharges the cleaning liquid supplied in the suction caps 72. Accordingly, the inside of the liquid ejecting apparatus 11 is less contaminated.

9. For example, when the cleaning liquid is supplied to overflow the suction caps 72 in a state in which the cleaning liquid supplied to the suction caps 72 is not in contact with the facing portion 46, the cleaning liquid overflows from a portion its surface tension balance is lost, and cleans only a part of the lip portions 79. However, if the cleaning liquid supplied in the suction caps 72 is brought into contact with the facing portion 46, the cleaning liquid readily wets and spreads in the space between the lip portions 79 and the facing portion 46, and thereby the entire lip portions 79 can be cleaned.

10. When the carriage 23 is moved with the cleaning liquid adhered to the facing portion 46, the cleaning liquid adhered to the facing portion 46 may be scattered or drip and contaminate the inside of the liquid ejecting apparatus 11. The wiping mechanism 51 performs a wiping operation to the facing portion 46 to wipe the cleaning liquid that has adhered to the facing portion 46. With this operation, the inside of the liquid ejecting apparatus 11 is less contaminated.

The embodiment may be modified as follows. Combinations of the embodiment and the following modifications may be made unless otherwise technically contradict each other. When the liquid ejector 30 is located in the printing area PA, the lip cleaning operation may be performed to the airflow regulation section 45 on the side closer to the first non-printing area LA than the liquid ejector 30 as the facing portion 46. For example, when the liquid ejector 30 is in the home position HP, the lip cleaning operation may be performed, in a state the standby caps 81 are in the standby capping state, to the airflow regulation section 45 facing the suction caps 72 as the facing portion 46.

When the liquid ejector 30 is located in the printing area PA, the lip cleaning operation may be performed to the airflow regulation section 45 on the side closer to the first non-printing area LA and the airflow regulation section 45 on the side closer to the second non-printing area RA than the liquid ejector 30 as the facing portion 46. For example, depending on the direction of the movement of the liquid ejector 30 in the X-axis direction, the airflow regulation section 45 to be used as the facing portion 46 may be selected.

Figure 12:
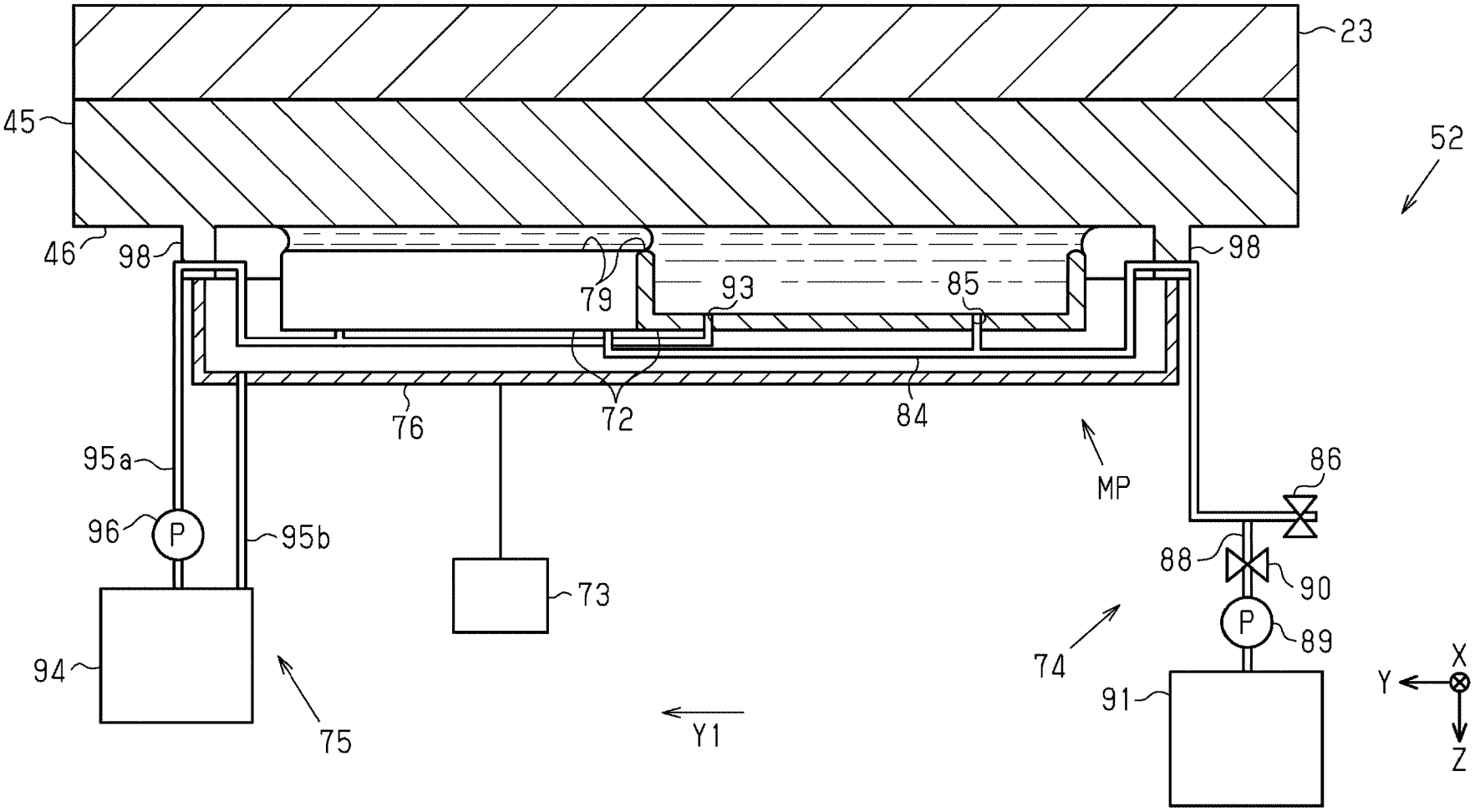
FIG. 12 is a schematic view illustrating a suction mechanism according to a modification.

As illustrated in FIG. 12, the airflow regulation section 45 may include positioning portions 98 that protrude downward from the facing portion 46. The suction mechanism 52 may locate the suction caps 72 to the maintenance position MP when the tub 76 moving together with the suction caps 72 comes into contact with the positioning portions 98.

The positioning portions 98 may engage with the concave portions 78 of the tub 76 similarly to the convex portions 30*a* of the liquid ejector 30 and position the suction caps 72 in the X-axis direction and the Y-axis direction. The airflow regulation section 45 may separately include the positioning portion 98 that comes into contact with the tub 76 and the positioning portion 98 that engages with the concave portion 78.

The controller 41 may locate the suction caps 72 to the maintenance position MP under the control of the capping mechanism 73. The suction caps 72 and the tub 76 may be integrally formed.

The protrusions 77 may be provided in the suction caps 72. The capping mechanism 73 may move the suction caps 72 and not move the tub 76. In the X-axis direction and the Y-axis direction, the through holes 44*a* may be larger than the suction caps 72. The lip portions 79 of the suction caps 72 may be brought into contact with the body 43 for capping. The nozzle surface 29 may be portions exposed from the through holes 44*a* in the body 43. The liquid ejector 30 may not include the cover 44. The facing portion 46 may be a surface of the cover 44.

The supply flow path 88 may be connected to the first discharge flow path 95*a*. The cleaning-liquid supply mechanism 74 may supply the cleaning liquid into the suction caps 72 via the first discharge flow path 95*a* and the discharge portion 93. In such a case, the discharge portion 93 functions as a communication portion.

The discharge mechanism 75 may not include the discharge pump 96. The discharge mechanism 75 may have a valve in the first discharge flow path 95*a* and by opening or closing the valve, flow the cleaning liquid in the suction caps 72 to the waste liquid tank 94 located below the suction caps 72.

After the cleaning liquid supplied in the suction caps 72 comes into contact with the facing portion 46, the suction caps 72 may hold the cleaning liquid. The discharge mechanism 75 may discharge the cleaning liquid when a wiping operation is performed to the facing portion 46 or after a wiping operation is performed by the wiping mechanism 51. The discharge mechanism 75 may discharge the cleaning liquid before a suction cleaning is performed or when a suction cleaning is performed.

The cleaning-liquid supply mechanism 74 may supply the cleaning liquid to the standby cap 81, which is an example cap. The moisture retention liquid supply section 56 may use the moisture retention liquid as the cleaning liquid and perform cleaning of the lip portion of the moisture retention cap 55, which is an example cap. To the moisture retention caps 55 and the standby caps 81, the discharge mechanism 75 may not be provided. The moisture retention caps 55 and the standby caps 81 may perform the capping to the liquid ejector 30 while holding the supplied cleaning liquid.

The liquid ejecting apparatus 11 may include a plurality of wiping mechanisms 51. The liquid ejecting apparatus 11 may include a wiping mechanism 51 for the liquid ejector 30 and a wiping mechanism 51 for the facing portion 46. The wiping mechanism 51 may perform the wiping with the wiping member 65 that can absorb liquid and a cleaning liquid. Alternatively, the wiping mechanism 51 may wipe liquid or a cleaning liquid, for example, with a wiper that elastically deforms.

The controller 41 may cause the wiping mechanism 51 to wipe the facing portion 46 while the facing portion 46 is in a position facing the lip portions 79. The carriage 23 moved after the wiping of the cleaning liquid adhered to the facing portion 46 reduces an occurrence of scattering or dripping of the cleaning liquid, resulting in reduced contamination inside the liquid ejecting apparatus 11.

The facing portion 46 and the carriage 23 may be separately provided. The facing portion 46 may be fixed to a position where the facing portion 46 can face the lip portions 79. For example, the facing portion 46 may be disposed in a position shifted in the Y-axis direction with respect to the suction caps 72. The capping mechanism 73 may move the suction caps 72 in the Y-axis direction such that the lip portions 79 and the facing portion 46 face each other. The facing portion 46 may be movably disposed to a member different from the carriage 23.

The liquid ejecting apparatus 11 may not include the airflow regulation section 45. The facing portion 46 may be a lower surface of the carriage 23. The controller 41 may move the suction caps 72 in the separated position EP in the Z-axis direction to a position a predetermined space is provided between the lip portions 79 and the facing portion 46 when the lip portions 79 face the facing portion 46, and then move the liquid ejector 30 in the X-axis direction such that the facing portion 46 faces the lip portion 79.

The controller 41 may start the supply of the cleaning liquid into the suction caps 72 after the predetermined space is provided between the lip portions 79 and the facing portion 46. The cleaning-liquid supply mechanism 74 may supply the cleaning liquid into the suction caps 72 from an upper portion of the suction caps 72. For example, the cleaning liquid may be supplied from the nozzles 28 to the suction caps 72. The cleaning liquid may be supplied from supply ports on the airflow regulation section 45 to the suction caps 72.

The liquid ejector 30 may be a so-called line head capable of performing printing over a medium ST in the X-axis direction. The liquid ejecting apparatus 11 may not include the carriage 23. The liquid ejector 30 may not be moved in the X-axis direction.

The facing portion 46 and the lip portions 79 may be formed of the same material. Specifically, a contact angle between the surface of the facing portion 46 and liquid droplets of the cleaning liquid may be the same as a contact angle between the surface of the lip portion 79 and liquid droplets of the cleaning liquid. The contact angle between the surface of the facing portion 46 and liquid droplets of the cleaning liquid may be larger than a contact angle between the surface of the lip portion 79 and liquid droplets of the cleaning liquid.

The cleaning-liquid supply mechanism 74 may supply the cleaning liquid into the suction caps 72 to clean at least one of the open flow path 84, the suction caps 72, and the first discharge flow path 95*a*. The discharge mechanism 75 may discharge the cleaning liquid in the suction caps 72 through the first discharge flow path 95*a* to clean the first discharge flow path 95*a*. In such a case, the cleaning-liquid supply mechanism 74 may supply the cleaning liquid into the suction caps 72 in a state in which the space between the lip portions 79 and the facing portion 46 is larger than the predetermined space. The cleaning-liquid supply mechanism 74 and the discharge mechanism 75 may supply or discharge the cleaning liquid such that the liquid surface of the cleaning liquid in the suction caps 72 is lower than the lip portion 79.

The liquid ejecting apparatus 11 may be a liquid ejecting apparatus that ejects or discharges liquid other than ink. The state of the liquid discharged as a minute amount of droplets from the liquid ejecting apparatus includes granular droplets, tear droplets, or stringy droplets. The liquid may be any material that can be discharged from the liquid discharge apparatus. For example, the liquid may be any material in a liquid phase, including a liquid having high or low viscosity, or a fluid material such as sol, gel water, other inorganic solvents, an organic solvent, a solution, a liquid resin, a liquid metal, or a metal melt. The liquid is not limited to liquid that is in one state of a material but includes a liquid in which particles of a functional material composed of a solid material such as a pigment or metal particles are dissolved, dispersed, or mixed in a solvent. Typical examples of the liquid include the inks like those described in the above embodiment, liquid crystal, and the like. The ink may be inks that contain various kinds of liquid compositions, such as general water-based inks, oil-based inks, gel inks, hot melt inks, and the like. The liquid ejecting apparatus may be, for example, a liquid ejecting apparatus that discharges a liquid containing a dispersed or dissolved material such as an electrode material or a color material to be used for manufacturing liquid crystal displays, electroluminescence (EL) displays, field emission displays (FEDs), or color filters. Furthermore, the liquid ejecting apparatus may be an apparatus that discharges a bioorganic material to be used for biochip manufacture, an apparatus that is used as a precision pipette and discharges a liquid that is used as a sample, a textile printing apparatus, a micro dispenser, or the like. Furthermore, the liquid ejecting apparatus may be an apparatus that discharges lubricating oil with pinpoint precision onto a precision machine such as a watch, a camera, or the like, or an apparatus that discharges a transparent resin liquid such as an ultraviolet curing resin onto a substrate to form a micro hemispherical lens, an optical lens, or the like to be used for an optical communication element or the like. Furthermore, the liquid ejecting apparatus may be an apparatus that discharges an etching solution such as acid or alkali to etch a substrate or the like.

Hereinafter, technical ideas and their operations and effects according to the above-described embodiment and the modifications will be described. A liquid ejecting apparatus includes a liquid ejector having a nozzle surface having nozzles from which a liquid is to be ejected, a cap configured to perform, when the cap comes into contact with the nozzle surface, capping for covering a space in which the nozzles are open, a capping mechanism configured to move the cap between a capping position for the capping and a separated position separated from the nozzle surface, a cleaning-liquid supply mechanism configured to supply a cleaning liquid into the cap, a facing portion configured to face a lip portion of the cap coming into contact with the nozzle surface in the capping, and a controller configured to control the capping mechanism and the cleaning-liquid supply mechanism such that the lip portion faces the facing portion and a predetermined space is provided between the lip portion and the facing portion for the cleaning liquid supplied in the cap to come into contact with the facing portion.

With this structure, a cleaning-liquid supply mechanism can supply a cleaning liquid into a cap in a state a facing portion faces a lip portion and a predetermined space is provided between the lip portion and the facing portion. The cleaning liquid supplied in the cap comes into contact with the facing portion. The lip portion can be thus wetted and cleaned by the cleaning liquid.

In the liquid ejecting apparatus, a contact angle between a surface of the facing portion and liquid droplets of the cleaning liquid may be smaller than a contact angle between a surface of the lip portion and liquid droplets of the cleaning liquid.

In this structure, the surface of the facing portion has higher wettability than the surface of the lip portion. Accordingly, when the cleaning liquid supplied in the cap come into contact with the surface of the facing portion, the cleaning liquid readily wets and spreads to the outside of the cap and the lip portion can be readily cleaned.

The liquid ejecting apparatus may include a carriage configured to hold and move the liquid ejector, and the facing portion may be provided in the carriage. In this structure, the facing portion is provided in the carriage to which the liquid ejector is mounted. Accordingly, by moving the carriage, the lip portion and the facing portion can face each other.

In the liquid ejecting apparatus, the cleaning-liquid supply mechanism may be configured to supply the cleaning liquid into the cap via a communication portion that is open in the cap. This structure may be used as the cleaning-liquid supply mechanism.

A method of maintaining a liquid ejecting apparatus including a liquid ejector having a nozzle surface having nozzles from which a liquid is to be ejected, a cap configured to perform capping for covering a space in which the nozzles are open when the cap comes into contact with the nozzle surface, a capping mechanism configured to move the cap between a capping position for the capping and a separated position separated from the nozzle surface, a cleaning-liquid supply mechanism configured to supply a cleaning liquid into the cap, and a facing portion configured to face a lip portion of the cap coming into contact with the nozzle surface in the capping is provided. The method includes making the lip portion and the facing portion face each other and providing a predetermined space between the lip portion and the facing portion for the cleaning liquid supplied in the cap to come into contact with the facing portion. According to the method, effects similar to those obtained by the above-described liquid ejecting apparatus can be achieved.

In the method of maintaining the liquid ejecting apparatus, before providing the predetermined space between the lip portion and the facing portion, the supply of the cleaning liquid into the cap may be started.

According to the method, the cleaning-liquid supply mechanism starts the supply of the cleaning liquid before providing the predetermined space between the lip portion and the facing portion. With this operation, the time necessary to clean the lip portion can be reduced as compared with, for example, a case in which the supply of the cleaning liquid is started by the cleaning-liquid supply mechanism after the predetermined space is provided between the lip portion and the facing portion.

In the method of maintaining the liquid ejecting apparatus, after making the lip portion of the cap in the separated position and the facing portion face each other, the cap may be moved from the separated position toward the facing portion to provide the predetermined space between the lip portion and the facing portion.

According to the method, after the lip portion faces a facing portion, the cap in the separated position is moved from the separated position toward the facing portion to provide the predetermined space between the lip portion and the facing portion. Accordingly, the cap in the separated position can be moved with a distance between the lip portion and the facing portion until the predetermined space is provided between the lip portion and the facing portion.

In the method of maintaining the liquid ejecting apparatus, before the lip portion and the facing portion face each other, the supply of the cleaning liquid into the cap may be started. According to the method, before the lip portion and the facing portion face each other, the cleaning-liquid supply mechanism starts the supply of the cleaning liquid. Accordingly, the time necessary to clean the lip portion can be reduced as compared with, for example, a case in which the supply of the cleaning liquid is started by the cleaning-liquid supply mechanism after the lip portion face the facing portion.

In the method of maintaining the liquid ejecting apparatus, the liquid ejecting apparatus may further include a carriage configured to hold and move the liquid ejector, and a wiping mechanism for wiping the nozzle surface. In the method, after making the lip portion and the facing portion face each other and providing a predetermined space between the lip portion and the facing portion for the cleaning liquid supplied in the cap to come into contact with the facing portion, the carriage may be moved, and the facing portion may be wiped by the wiping mechanism.

According to the method, a wiping mechanism for wiping the nozzle surface performs a wiping operation to the facing portion. Accordingly, the number of components can be reduced as compared with a case in which the mechanism for wiping the nozzle surface and the mechanism for wiping the facing portion are separately provided.

In the method of maintaining the liquid ejecting apparatus, the liquid ejecting apparatus may further include a discharge mechanism configured to discharge the liquid in the cap. In the method, after the cleaning liquid supplied into the cap comes into contact with the facing portion, before wiping the facing portion by the wiping mechanism, the cleaning liquid supplied in the cap may be discharged by the discharge mechanism.

When the cap storing the cleaning liquid is moved, the cleaning liquid may be scattered and the inside of the liquid ejecting apparatus may be contaminated. To solve the problem, the discharge mechanism discharges the cleaning liquid supplied in the cap. With this operation, the inside of the liquid ejecting apparatus is less contaminated.

What is claimed is:

1. A liquid ejecting apparatus comprising:

a liquid ejector having a nozzle surface having nozzles from which a liquid is to be ejected;

a cap configured to perform capping for covering a space in which the nozzles are open;

a capping mechanism configured to move the cap between a capping position for the capping and a separated position separated from the nozzle surface;

a cleaning-liquid supply mechanism configured to supply a cleaning liquid into the cap;

a facing portion configured to face a lip portion of the cap when the cap is in the capping position, the lip portion being an upper end of the cap and having an upper opening for holding the cleaning liquid; and a controller configured to control the capping mechanism and the cleaning-liquid supply mechanism such that the lip portion faces the facing portion and a predetermined space is provided between the lip portion and the facing portion for the cleaning liquid supplied in the cap to come into contact with the facing portion.

2. The liquid ejecting apparatus according to claim 1, wherein a contact angle between a surface of the facing portion and liquid droplets of the cleaning liquid is smaller than a contact angle between a surface of the lip portion and liquid droplets of the cleaning liquid.

3. The liquid ejecting apparatus according to claim 1, further comprising:

a carriage configured to hold and move the liquid ejector, wherein the facing portion is disposed in the carriage.

4. The liquid ejecting apparatus according to claim 1, wherein the cleaning-liquid supply mechanism is configured to supply the cleaning liquid into the cap via a communication portion that is open in the cap.

5. The liquid ejecting apparatus according to claim 1, wherein a liquid repellency of a surface of the lip portion is higher than a liquid repellency of a surface of the facing portion.

6. The liquid ejecting apparatus according to claim 1, wherein the predetermined space is determined based on a liquid repellency of a surface of the lip portion, such that even though there is the predetermined space between the lip portion and the facing portion, the liquid supplied in the cap is still able to come into contact with the facing portion.

7. A method of maintaining a liquid ejecting apparatus including:

a liquid ejector having a nozzle surface having nozzles from which a liquid is to be ejected;

a cap configured to perform capping for covering a space in which the nozzles are open;

a capping mechanism configured to move the cap between a capping position for the capping and a separated position separated from the nozzle surface;

a cleaning-liquid supply mechanism configured to supply a cleaning liquid into the cap; and a facing portion configured to face a lip portion of the cap when the cap is in the capping position, the lip portion being an upper end of the cap and having an upper opening for holding the cleaning liquid, the method comprising:

making the lip portion and the facing portion face each other and providing a predetermined space between the lip portion and the facing portion for the cleaning liquid supplied in the cap to come into contact with the facing portion.

8. The method of maintaining the liquid ejecting apparatus according to claim 7, wherein before providing the predetermined space between the lip portion and the facing portion, starting the supply of the cleaning liquid into the cap.

9. The method of maintaining the liquid ejecting apparatus according to claim 7, wherein after making the lip portion of the cap in the separated position and the facing portion face each other, moving the cap from the separated position toward the facing portion to provide the predetermined space between the lip portion and the facing portion.

10. The method of maintaining the liquid ejecting apparatus according to claim 9, wherein before the lip portion and the facing portion face each other, starting the supply of the cleaning liquid into the cap.

11. The method of maintaining the liquid ejecting apparatus according to claim 7, wherein the liquid ejecting apparatus further comprises a carriage configured to hold and move the liquid ejector, and a wiping mechanism for wiping the nozzle surface, wherein after making the lip portion and the facing portion face each other and providing a predetermined space between the lip portion and the facing portion for the cleaning liquid supplied in the cap to come into contact with the facing portion, moving the carriage, and wiping the facing portion by the wiping mechanism.

12. The method of maintaining the liquid ejecting apparatus according to claim 11, wherein the liquid ejecting apparatus further comprises a discharge mechanism configured to discharge the liquid in the cap, wherein after the cleaning liquid supplied into the cap comes into contact with the facing portion, before wiping the facing portion by the wiping mechanism, discharging the cleaning liquid supplied in the cap by the discharge mechanism.

* * * * *